US009196413B2

(12) United States Patent
Esaki et al.

(10) Patent No.: US 9,196,413 B2
(45) Date of Patent: Nov. 24, 2015

(54) REACTOR AND COMPOUND USED IN SAME

(71) Applicant: Daido Steel Co. LTD., Nagoya-shi (JP)

(72) Inventors: Junichi Esaki, Nagoya (JP); Yusuke Tozawa, Nagoya (JP); Yoshitomo Kajinami, Nagoya (JP); Kousuke Yoshimoto, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 0 days.

(21) Appl. No.: 14/351,534

(22) PCT Filed: Sep. 19, 2012

(86) PCT No.: PCT/JP2012/073949

§ 371 (c)(1),
(2) Date: Jul. 14, 2014

(87) PCT Pub. No.: WO2013/042691

PCT Pub. Date: Mar. 28, 2013

(65) Prior Publication Data

US 2014/0333401 A1 Nov. 13, 2014

(30) Foreign Application Priority Data

Sep. 20, 2011 (JP) ..... 2011-205402

(51) Int. Cl.
*H01F 27/24* (2006.01)
*H01F 27/02* (2006.01)
(Continued)

(52) U.S. Cl.
CPC ..... *H01F 27/22* (2013.01); *H01F 1/01* (2013.01); *H01F 1/26* (2013.01); *H01F 27/255* (2013.01);
(Continued)

(58) Field of Classification Search
CPC ..... H01F 41/0246; H01F 41/02; H01F 17/04; H01F 3/08; H01F 37/00; H01F 27/255; H01F 27/327; H01F 27/22; H01F 27/2871; H01F 27/085; H01F 2017/048; H01F 1/01
USPC ..... 336/83, 233, 221; 252/62.54
See application file for complete search history.

(56) References Cited

U.S. PATENT DOCUMENTS 6,342,557 B1 1/2002 Suzuki et al.
6,469,606 B1 * 10/2002 Tada et al. ..... 336/83
(Continued)

FOREIGN PATENT DOCUMENTS

JP 2000-91115 A 3/2000
JP 2001-139833 A 5/2001
(Continued)

OTHER PUBLICATIONS

United States Office Action dated Jan. 12, 2015 in co-pending U.S. Appl. No. 14/351,533.
(Continued)

*Primary Examiner* — Mangtin Lian
(74) *Attorney, Agent, or Firm* — McGinn IP Law Group, PLLC.

(57) ABSTRACT

[Problem] Provided is an injection-molded reactor which has excellent heat dissipation properties and in which the internal temperature of the core can be satisfactorily inhibited from rising due to heat generation when the reactor is in operation. [Solution Means] A material for a core obtained by mixing a soft magnetic powder, a resin binder, and a thermally conductive fibrous filler having a higher thermal conductivity than the soft magnetic powder in accordance with X·(soft magnetic powder)+Y·(thermally conductive filler)+(100-X-Y)·(resin binder), wherein X, indicating the proportion of the soft magnetic powder, is 83 to 96% by mass and Y, indicating the proportion of the thermally conductive filler, is 0.2 to 6.8% by mass, is used to mold a core 16 so that a coil 10 obtained by winding an electric wire is embedded therein without an interval, thereby configuring a reactor 15.

20 Claims, 14 Drawing Sheets

(51) Int. Cl.

| | |
|---|---|
| ***C04B 35/04*** | (2006.01) |
| ***H01F 27/22*** | (2006.01) |
| ***H01F 1/26*** | (2006.01) |
| ***H01F 37/00*** | (2006.01) |
| ***H01F 27/255*** | (2006.01) |
| ***H01F 27/28*** | (2006.01) |
| ***H01F 1/01*** | (2006.01) |
| ***H01F 27/32*** | (2006.01) |
| *H01F 17/04* | (2006.01) |

(52) U.S. Cl.
CPC ..... *H01F 27/2871* (2013.01); *H01F 27/327* (2013.01); *H01F 37/00* (2013.01); *H01F 2017/048* (2013.01)

(56) References Cited

U.S. PATENT DOCUMENTS

| | | | |
|---|---|---|---|
| 6,517,744 | B1 | 2/2003 | Hara et al. |
| 2003/0127157 | A1 | 7/2003 | Iyoda et al. |
| 2015/0022301 | A1* | 1/2015 | Esaki et al. ..... 336/83 |

FOREIGN PATENT DOCUMENTS

| | | | |
|---|---|---|---|
| JP | 2003-183702 | A | 7/2003 |
| JP | 2005-243769 | A | 9/2005 |
| JP | 2007-027185 | A | 2/2007 |
| JP | 2008-147403 | A | 6/2008 |
| JP | 2008-147404 | A | 6/2008 |
| JP | 2008-147405 | A | 6/2008 |
| JP | 2009-176974 | A | 8/2009 |
| JP | 2010-214590 | A | 9/2010 |
| JP | 2010-283379 | A | 12/2010 |
| JP | 2011-142193 | A | 7/2011 |

OTHER PUBLICATIONS

International Search Report (ISR) (PCT Form PCT/ISA/2010), in PCT/JP2012/073950, dated Oct. 23, 2012.

International Search Report (ISR) (PCT Form PCT/ISA/210), in PCT/JP2012/073949, dated Oct. 16, 2012.

* cited by examiner (A)

(B)

REACTOR AND COMPOUND USED IN SAME

TECHNICAL FIELD

The present invention relates to a reactor obtained by molding a core so that a coil is embedded in an inner portion without an interval, and to a compound for a core used therein.

BACKGROUND ART

Reactors which are inductance parts including a core having a built-in coil configured of a wound electric wire have conventionally been used in various fields.

For example, in hybrid vehicles, fuel cell vehicles, electric vehicles, or the like, a booster circuit has been disposed between the battery and the inverter which supplies alternating current power to a motor (electric motor), and a reactor (choke coil) which is an inductance part is used in the booster circuit.

In hybrid vehicles, for example, the battery has a voltage of about 300 V at the most, while it is necessary to apply a high voltage of about 600 V to the motor so as to obtain high output. A reactor is used as a part for the booster circuit for that purpose.

Such reactors are in extensive use in booster circuits for photovoltaic power generation and in other applications.

The reactor in operation generates heat and, due to the heat generation, the internal temperature of the core undesirably reaches a high temperature. In some cases, the inner part of the core partly heats up to a temperature higher than a set permissible maximum temperature.

For example, reactors for use in the booster circuits of vehicles are parts that are used over an exceedingly long period, and in the case where temperature rising is repeated for a long period, the resin binder deteriorates due to the heat history, resulting in a decrease in the life of the parts.

Consequently, a temperature permitted to be reached (maximum temperature) is set for reactors, and the temperature rising due to internal heat generation is required not to result in a temperature higher than the set maximum temperature.

As a prior-art technique relevant to the present invention, the following patent document 1 discloses a feature wherein, since a reactor including a coil covered with a core has a problem in that the internal temperature of the vicinity of the coil is apt to rise, a heat sink piece which is constituted of a rod member made of aluminum and which is for dissipating the heat from the coil to the outer case has been disposed in the core.

It is, however, noted that the reactor disclosed in patent document 1 differs from the present invention in means for heat dissipation.

Meanwhile, patent document 2 shows an invention relating to a "reactor", and discloses a feature wherein an electrically non-conductive filler is added to a mixture of a soft magnetic powder and a resin to regulate the viscosity of the mixture and a feature wherein the heat dissipation properties of the soft-magnetic composite material can be improved in cases when a material having a high thermal conductivity, such as, in particular, $Al_2O_3$, BN, or AlN, is used as the filler.

However, patent document 2 does not disclose a feature wherein fibrous filler is used as the filler having a high thermal conductivity, and differs from the present invention in this respect.

CITATION LIST

Patent Documents

Patent Document 1: JP-A-2011-142193
Patent Document 2: JP-A-2010-283379

SUMMARY OF THE INVENTION

Problem that the Invention is to Solve

The present invention has been made in consideration of the above-described circumstances, and an object thereof is to provide a reactor which has excellent heat dissipation properties and in which the internal temperature of the core can be satisfactorily inhibited from rising due to heat generation when the reactor is in operation, and to provide a compound for a core which is used for producing the reactor.

Means for Solving the Problem

Claim 1 relates to a reactor, wherein a material for a core obtained by mixing a soft magnetic powder, a resin binder and a thermally conductive fibrous filler having a higher thermal conductivity than that of the soft magnetic powder, in a proportion represented by the following expression (1); and the core is molded by using the material for a core in a state where a coil in which an electric wire is wound is embedded in an inner portion without an interval to configure the reactor, $$X\cdot(\text{soft magnetic powder})+Y\cdot(\text{thermally conductive filler})+(100-X-Y)\cdot(\text{resin binder}) \quad \text{expression (1)}$$

wherein X is 83 to 96% by mass and Y is 0.2 to 6.8% by mass.

Claim 2 relates to an injection-molded reactor according to claim 1, wherein a thermoplastic resin binder is used as the resin binder; a compound for a core, as the material for a core, obtained by mixing in the proportion represented by the expression (1) is used; and the core is injection-molded by using the compound for a core in a state where the coil is embedded in the inner portion without an interval to configure the injection-molded reactor.

Claim 3 relates to the injection-molded reactor according to claim 2, wherein the thermally conductive filler is carbon fibers.

Claim 4 relates to a compound for a core in the injection-molded reactor, and the compound for a core being characterized by being the compound as the material for a core of the injection-molded reactor described in claim 2 or 3.

Advantage of the Invention

As stated above, the reactor of the invention is a reactor in which the core was molded using a mixture obtained by mixing a soft magnetic powder, a resin binder, and a thermally conductive fibrous filler having a higher thermal conductivity than the soft magnetic powder, as a material for a core, so that the thermally conductive filler is contained in a dispersed state in the core.

In the invention, the thermal conductivity of the entire core can be effectively heightened by using, as a thermally conductive filler, a filler having a higher thermal conductivity than the soft magnetic powder. Thus, heat dissipation properties can be enhanced, and the core can be effectively inhibited from increasing in temperature.

It is desirable that the thermally conductive filler to be used should be a filler having a thermal conductivity of 70 (W/m·K) or higher.

It is more desirable to use a filler having a thermal conductivity of 150 (W/m·K) or higher, and it is even more desirable to use a filler having a thermal conductivity of 450 (W/m·K) or higher.

In this connection, in cases when pure Fe, Fe-1 Si containing 1% by mass of Si, Fe-2Si containing 2% by mass of Si, Fe-5Si containing 5% by mass of Si, and Fe-6.5Si containing 6.5% of Si, are used as soft magnetic powders, the thermal conductivities thereof are as follows.

Pure Fe: 67 (W/m·K)
Fe-1Si: 42 (W/m·K)
Fe-2Si: 31 (W/m·K)
Fe-5Si: 19 (W/m·K)
Fe-6.5Si: 15 (W/m·K)

Incidentally, the thermal conductivity of PPS (polyphenylene sulfide) resins used in the resin binder is as follows.

PPS: 0.2 to 0.4 (W/m·K)

In the invention, a fibrous filler is used as the thermally conductive filler.

In the case where the thermally conductive filler is fibrous, this thermally conductive filler, that is, fiber, is dispersed in the state of being entangled with one another within the core, thereby effectively constituting a network of heat conduction paths. As a result, the core exhibits high heat dissipation properties.

Due to this function, the increase in internal temperature due to the heat generation by the reactor in operation can be highly effectively inhibited.

In the invention, in cases when the mixing ratio of the soft magnetic powder is expressed by X, the mixing ratio of the thermally conductive filler is expressed by Y, and the mixing ratio of the resin binder is expressed by (100-X-Y), then X is 83 to 96% by mass and Y is 0.2 to 6.8% by mass.

In the case where the mixing ratio of the soft magnetic powder is less than 83% by mass, it is difficult to obtain a desired value of inductance and the temperature rising due to heat generation becomes severer.

The temperature rising due to heat generation tends to decrease as the mixing ratio of the soft magnetic powder increases, due to the heat dissipation properties of the soft magnetic powder, which has a higher thermal conductivity than the resin. Furthermore, the inductance becomes higher as the mixing ratio of the powder increases. Meanwhile, however, the flowability of the mixture (compound) in injection molding conducted as a technique for core molding decreases as the powder mixing ratio increases. In the case where the mixing ratio of the powder is increased beyond 96%, this compound comes to have a low value of flowability unsuitable for mass production.

On the other hand, with respect to the thermally conductive filler, in the case where the mixing ratio thereof is less than 0.2%, it is difficult to effectively inhibit the core from increasing in temperature.

As the mixing ratio of the thermally conductive filler is increased, the effect of inhibiting the temperature rising becomes higher accordingly. However, the addition of the thermally conductive filler reduces the flowability of the mixture during the injection molding of the core. Especially in the case where the mixing ratio thereof is increased to above 6.8%, a considerable decrease in flowability results, making it difficult to produce reactors by injection molding on a mass-production scale.

In the case where an electrically conductive filler, that is, carbon fibers, is used as the thermally conductive filler, an eddy current occurs in the carbon fibers during voltage application because of the electrical conductivity thereof, resulting in heat generation and a loss. Especially in the case of a highly thermally conductive filler having a thermal conductivity of 400 (W/m·K) or higher, this filler has higher electrical conductivity accordingly. Because of this, the heat generation and loss which are attributable to the thermally conductive filler itself are further enhanced.

Consequently, the proportion Y in claim 1 is 6.8% or less.

In the invention, it is possible to use a thermosetting resin binder as the resin binder and to mold a core by the so-called potting so that a coil is embedded in an inner portion without an interval. Namely, the reactor can be a potting-molded reactor.

In this case, however, not only a large heating furnace for curing the thermosetting resin binder is necessary as will be described later, but also a large amount of heat energy for the curing is required and a prolonged time period is necessary for the curing. There is hence a problem in that an increase in cost results and it is difficult to heighten manufacturability.

It is therefore desirable that the reactor should be an injection-molded reactor, that is, an injection-molded reactor produced by injection-molding a core using a compound for a core as the material for the core so that the coil is embedded in an inner portion without an interval, the compound for the core being a compound obtained using a thermoplastic resin binder as the resin binder and obtained by mixing the ingredients in a proportion represented by the expression (1) (claim 2).

Claim 2 necessitates neither a large heating furnace nor a large amount of heat energy for curing the resin binder, and can heighten manufacturability to attain a reduction in required cost.

In the invention, thermally conductive fillers made of various materials can be used. However, carbon fibers may be suitably used (claim 3).

Carbon fibers include pitch-based carbon fibers and PAN-based carbon fibers, and either of the two types is usable. However, pitch-based carbon fibers, which have a high thermal conductivity (150 (W/m·K) or higher), are preferred.

Carbon fibers which are equally of the pitch-based type are classified by graphite crystallinity into grades differing in thermal conductivity and electrical resistance. The grade which has a thermal conductivity as high as about 800 (W/m·K) at the most but has an electrical resistance as low as 2 (μΩ·m) or less has an exceedingly high graphite crystallinity. Conversely, the grade which has a thermal conductivity as low as 150 (W/m·K) but has an electrical resistance as high as 6 to 7 (μΩ·m) has a slightly reduced graphite crystallinity.

Such pitch-based carbon fibers of either grade can be satisfactorily used. However, carbon fibers having a thermal conductivity of 450 (W/m·K) or higher are especially suitable for effectively enhancing the heat dissipation properties of the core.

In addition, in the case where the carbon fibers are partly or wholly replaced with carbon fibers of a grade having high electrical resistance, it is possible to heighten the heat dissipation properties of the core while reducing the eddy current loss which occurs in the core.

Next, claim 4 relates to a compound for the core of an injection-molded reactor. By injection-molding the core of a reactor using the compound of claim 4, the heat dissipation properties of the core can be effectively heightened and the internal temperature of the core can be satisfactorily inhibited from rising.

In the invention, other configurations of the reactor may be as follows.

(With Respect to Components of the Soft Magnetic Powder)

It is desirable in the invention that a powder of pure Fe or a powder having a composition containing 0.2 to 9.0% (% by mass; the same applies hereinafter) of Si should be used as the soft magnetic powder.

Pure Fe has the drawback of being high in core loss, but is inexpensive and easy to handle and has the feature of being second in magnetic flux density only to Permendur among the magnetic materials. Consequently, it is desirable to use a powder of pure Fe in the case where that feature is important.

The powder of an Fe-based soft magnetic alloy which contains 0.2 to 9.0% of Si comes to have a lower magnetic flux density than pure Fe as the Si content increases. However, this powder is effective in reducing core loss. This powder hence has an advantage in that a satisfactory balance between the two properties is attained and that the powder is easy to handle.

Especially when the Si content is 6.5%, the core loss has a minimum value and the magnetic flux density is relatively high. This powder is hence an excellent soft magnetic material.

As the Si content exceeds beyond 6.5%, the core loss comes to increase. However, this powder in which the Si content is up to 9.0% is fully practical because the magnetic flux density thereof is high.

It is, however, noted that the powder in which the Si content is higher than 9.0% has a low magnetic flux density and causes an increase in core loss.

Meanwhile, in the case where the Si content is less than 0.2%, this powder has substantially the same features as pure Fe.

A powder of an Fe-based soft magnetic alloy which contains Si in an amount of 6 to 7% attains a satisfactory balance between inductance characteristics and heat generation properties. In the case where these properties are important, it is desirable to use the powder having a composition containing 6 to 7% of Si.

Meanwhile, a powder which contains 2 to 3% of Si attains a satisfactory balance between cost and performances including inductance characteristics and heat generation properties. In the case where this feature is important, it is desirable to use the powder containing 2 to 3% of Si.

In the invention, it is possible to add beforehand one or more of Cr, Mn, and Ni as optional elements to the soft magnetic powder according to need.

In the case of adding Cr, however, it is desirable to regulate the addition amount thereof to 5% by mass or less. This is because this regulation facilitates a further reduction in core loss.

Furthermore, it is desirable that the total content of Mn and Ni should be 1% by mass or less. This is because such total content thereof makes it easy to maintain low coercive force.

(With Respect to the Powder)

The soft magnetic powder may use powder which is formed by an atomization method through gas atomization, water atomization, centrifugal atomization, combination thereof (for example, gas and water atomization), or rapid cooling just after the gas atomization, or the like, a mechanical crush method through a jet mill, a stamp mill, a ball mill, or the like, a chemical reduction, and the like.

From the viewpoint that mechanical energy is not required in the crush in which distortion is relatively decreased, a spherical type is easily formed, dispersibility is improved, or the like, it is preferable that the soft magnetic powder be powder formed by the atomization method. From the view point that the distortion is decreased, oxidation also is decreased, and the like, it is more preferable that the soft magnetic powder be a powder formed by a gas atomization method.

For example, from the viewpoint of yield of the powder at the time of the atomization, mixing torque or firing properties at the time of mixing, flowability at the time of the injection-molding, frequency used, or the like, a particle diameter of the soft magnetic powder is preferably a range of 1 to 500 μm, is more preferably a range of 5 to 250 μm, and is most preferably a range of 10 to 150 μm.

In the powder, effects which reduce eddy current loss are increased as the particle diameter is decreased. However, conversely, hysteresis loss may be increased. Therefore, it is preferable that the upper and lower limits of the particle diameter of the powder, distribution of the particle diameter, and the like are determined according to balance between the yield of the powder (that is, costs) and the obtained effects (that is core loss), the used frequency, or the like.

In order to remove the distortion or improve coarsening of crystal particles, it is preferable that the soft magnetic powder be subjected to a heat treatment. As conditions of the heat treatment, temperature of 700° C. to 1000° C. and times of 30 minutes to 10 hours under the atmosphere of either or both of hydrogen or argon may be exemplified.

(With Respect to the Resin Binder)

Examples of the thermoplastic resin usable as the resin binder for configuring the core together with the soft magnetic powder include polyphenylene sulfide (PPS) resins, polyamide (PA) resins, polyetheretherketone (PEEK) resins, polyester resins, polyethylene resins, and polypropylene resins, and examples of the thermosetting resin include polyurethane resins, epoxy resins, and silicone resins. These resins may be used alone, or two or more thereof may be used.

Suitable of these, from the standpoints of heat resistance, flame retardancy, insulating properties, moldability, mechanical strength, etc., are polyphenylene sulfide resins, polyamide resins, polyetheretherketone resins, and epoxy resins.

The resin binder may be one which contains one or more of various additives such as an antioxidant, aging inhibitor, ultraviolet absorber, colorant, thickener, sedimentation inhibitor, and thermal expansion inhibitor according to need.

(Process for Producing Reactor by Injection Molding)

The case of using a thermoplastic resin binder as the resin binder and the case of using a thermosetting resin binder as the resin binder differ from each other in production process. The reactor produced by injection molding using a thermoplastic resin binder (injection-molded reactor) and a process for producing this reactor are described first.

(Compound for Core)

A compound for a core which includes a soft magnetic powder, a thermoplastic resin binder, and a thermally conductive filler can be produced by mixing the soft magnetic powder, the resin binder, and the thermally conductive filler so as to result in a proper proportion and subjecting the resultant mixture to, for example, a step in which the ingredients are kneaded together using a kneader such as a twin-screw kneader, while keeping the resin binder in a molten state.

(Reactor Structure)

The injection-molded reactor may be configured in the following manner. A coil is encased in a state where the coil is entirely enclosed from the outside by the electrically insulating resin to configure the encased coil body, and the core is configured by the molded body which is formed by injection-molding the mixture (compound) including the soft magnetic powder and the thermoplastic resin in the state where the encased coil body is integrally embedded in the inner portion of the core. The core is configured so that the primary molded body which includes the tubular outer circumferential molded portion contacting the outer circumferential surface of the encased coil body, and the secondary molded body which includes an inner circumferential molded portion contacting the inner circumferential surface of the encased coil body are joined to each other at a boundary surface and are integrated.

The reactor having such a configuration can be produced in the following manner.

Namely, the reactor can be produced using the following method. Step A which injection-molds the core is divided into the step A-1 which injection-molds the primary molded body which includes a tubular outer circumferential molded portion of the core contacting the outer circumferential surface of the encased coil body in the shape having the opening for inserting the encased coil body in one end side in the coil axial direction in advance, and the step A-2 which molds the secondary molded body which includes the inner circumferential molded portion contacting the inner circumferential surface of the encased coil body; and in the step A-2, the secondary molded body which includes the inner circumferential molded portion is molded in the state where the encased coil body is fitted to the outer circumferential molded portion of the primary molded body obtained through the step A-1 in the state of being innerly fitted and the outer circumferential molded portion is held so as to be constrained in the radial direction from the outer circumferential side in the secondary molding die for the core, and simultaneously, the secondary molded body, the primary molded body, and the encased coil body are integrated with one another.

However, in the case where a core is injection-molded in such a manner that a coil is merely set within the injection molding die, the following difficult problem arises.

For example, the temperature of the mixture of the soft magnetic powder and the thermoplastic resin at the time of the injection into the cavity of the molding die is 300° C. or more in a liquid of a molten state, and after the injection, the mixture is cooled through the molding die in the inner portion of the molding die and solidified, and becomes a molded body.

At this time or thereafter, in the process in which the molded body is taken out from the molding die and is cooled to room temperature, the core which is the molded body tends to largely shrink in the radial direction.

However, since the coil made of a metal is positioned in the inner portion of the core, the core cannot shrink in the radial direction in the outer circumferential side of the coil (there is a great difference in a thermal expansion coefficient between the core and the coil made of a metal), as a result, the outer circumferential portion of the coil is shrunk in the circumferential direction, and a crack occurs in an outer circumferential molded portion.

The occurrence of the crack in the core becomes a factor which decreases the performance for the reactor.

However, in the case where a reactor having the configuration described above is produced by the process described above, this process is free from the problem in which during core molding, the outer circumferential molded portion cracks due to the coil located inside the core. This is because the outer circumferential portion (outer circumferential molded portion) of the core in this process has been molded alone in advance as a primary molded body separately from the coil.

Namely, since the primary molded body including the outer circumferential molded portion is molded alone in advance separately from the coil, the primary molded body or, more specifically, the outer circumferential molded portion can freely shrink with cooling during molding of the primary molded body.

Meanwhile, the secondary molded body including an inner circumferential molded portion which is in contact with the inner circumferential surface of a coil (strictly speaking, the inner circumferential surface of an encased coil body) is molded integrally with the coil, while keeping the coil set in the molding die. Since this inner circumferential molded portion does not particularly suffer any resistance by the coil when shrinking radially, this shrinkage does not especially pose the problem of cracking.

Namely, according to the production process described above, the problem in which the core cracks due to the presence of the coil can be effectively overcome.

In this production process, the secondary molded body which includes the inner circumferential molded portion can be molded in a state where the encased coil body is fitted to the outer circumferential molded portion of the primary molded body obtained through the step A-1 in the state of being innerly fitted and the outer circumferential molded portion is held so as to be constrained in the radial direction from the outer circumferential side in the secondary molding die for the core.

In the case where the secondary molded body of the core is molded in the state, the positional misalignment of the coil from the set position due to the injection pressure and the flow pressure can be prevented when the secondary molded body is molded, and the molding of the core can be completed in the state where the coil is precisely positioned at the previously-set position and held.

Accordingly, it is possible to favorably prevent the characteristics of the coil composite molded body from being subjected to adverse effects due to the positional misalignment of the coil at the time of molding the core.

The encased coil body can be configured by forming the resin covering layer from a thermoplastic resin which contains no soft magnetic powder, by joining a molded body including an outer-circumference covering portion that covers the outer circumferential surface of the coil to a molded body including an inner-circumference covering portion that covers the inner circumferential surface of the coil, thereby integrating the molded bodies with each other.

In the case where an encased coil body is thus configured, a reactor including this encased coil body can be produced in the following manner.

Namely, the resin covering layer of an encased coil body is formed by injection molding so that step B for the injection molding is divided into: step B-1 in which a primary molding die for resin covering layer formation is brought into contact with the inner circumferential surface or outer circumferential surface of a coil and a resin material is injected into the primary molding cavity of the primary molding die formed on the outer circumferential side or inner circumferential side of the coil in a state where the coil is constrained by the primary molding die so as to be positioned in a radial direction in the inner circumferential surface or the outer circumferential surface, thereby molding a primary molded body which includes the outer-circumference covering portion or inner-circumference covering portion in the resin covering layer and also integrating the primary molded body and the coil; and step B-2 in which the primary molded body is thereafter set, together with the coil, in a secondary molding die for resin covering layer formation and a resin material is injected into the secondary molding cavity of the secondary molding die formed on the inner circumferential side or outer circumferential side of the coil to mold a secondary molded body which includes the inner-circumference covering portion or outer-circumference covering portion of the resin covering layer and to integrate the secondary molded body, the coil, and the primary molded body. Reactor production can be thus conducted.

According to this production process, when the encased coil body is injection-molded, since the molding can be performed so as to be divided into two times, the encased coil body, that is, the resin covering layer can be favorably injection-molded in the state where the coil is held so as to be favorably positioned by the molding die, and it is thus possible to favorably prevent the positional misalignment of the coil due to the injection pressure or the flow pressure at the time of the molding, and the resin covering layer can be favorably molded in a coil-encasing state.

(Process for Producing Reactor by Potting)

A process for production in which a thermosetting resin binder is used as the resin binder is described below.

First, a thermosetting resin binder in a liquid state, a soft magnetic powder, and a thermally conductive filler are put together so as to result in a proper proportion, and these ingredients are mixed and brought into a dispersed state by means of, for example, a degassing stirrer. These, a liquid slurry is prepared as a material for a core.

Meanwhile, a coil can be produced beforehand as an encased coil body by the same production method as in the case of the injection-molded reactor described above.

The coil (encased coil body) is held at a given position in a case for potting, and the slurry is injected into the case while embedding the coil. Thereafter, the injected slurry is heated to a given temperature, and the liquid resin is caused to undergo a curing reaction over a given time period, thereby molding a core and simultaneously integrating the coil therewith. This process is called potting molding (cast molding) (disclosed, for example, in JP-A-2007-27185, JP-A-2008-147405, etc.).

In the case of this production process, however, not only a large heating furnace for curing the liquid resin binder with which a soft magnetic powder has been mixed is necessary, but also a large amount of heat energy for the curing is required and a prolonged time period is necessary for the curing. This process hence has drawbacks that an increase in cost results and it is difficult to heighten manufacturability.

In contrast, according to the process for production by injection molding, it is possible to overcome the various problems encountered in the process for production by potting described above.

The reactor of the invention may be suitably used as reactors for use in an alternating magnetic field having a frequency of 1 to 50 kHz, such as, for example, reactors for use in the booster circuits of hybrid vehicles, fuel cell vehicles, electric vehicles, or photovoltaic power generation.

MODES FOR CARRYING OUT THE INVENTION (Embodiment 1: Embodiments of Reactor Produced by Injection Molding)

Next, embodiments of the invention will be described below in detail by reference to drawings.

Figure 1:
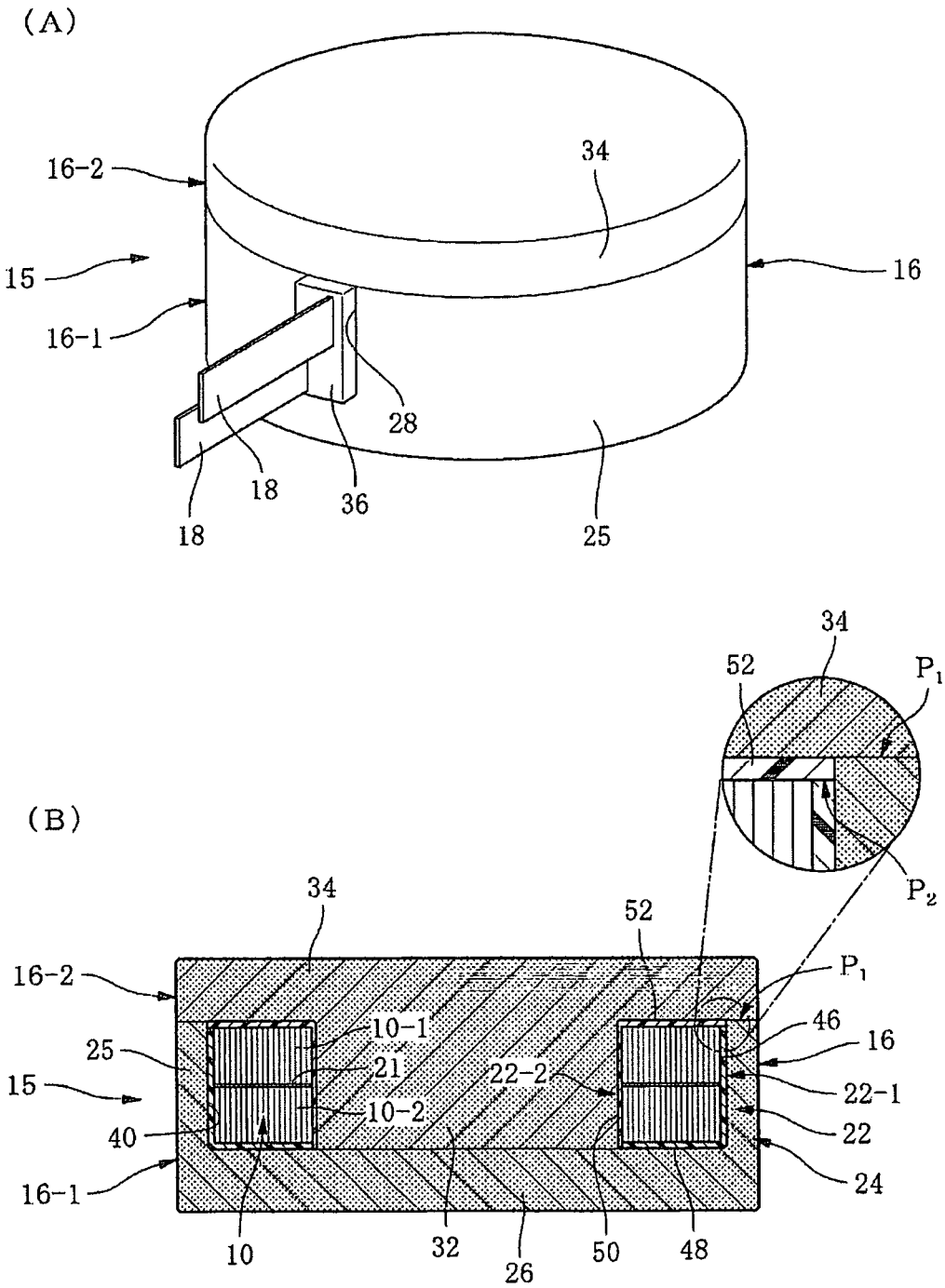
FIG. 1 describes views showing a reactor of an embodiment of the present invention

In FIG. 1, a reference numeral 15 is the reactor (choke coil) which is an inductance part, and a coil 10 with attached insulating coating is integrated so as to be an embedded state in the inner portion of a core 16 without leaving any space therebetween. That is, the core 16 is manufactured so as to be the reactor having structure with no gap.

In this embodiment, as shown in FIGS. 4 to 6(A), the coil 10 is a flat-wise coil and is formed in a coil shape by winding and superposing a rectangular wire in the thickness direction (radial direction) of the wire, in which wires adjacent in the radial direction in a state of a free shape which are processed to be wound and are molded to be superposed so as to be a state of being in contact with one another via the insulating coating.

Figure 4:
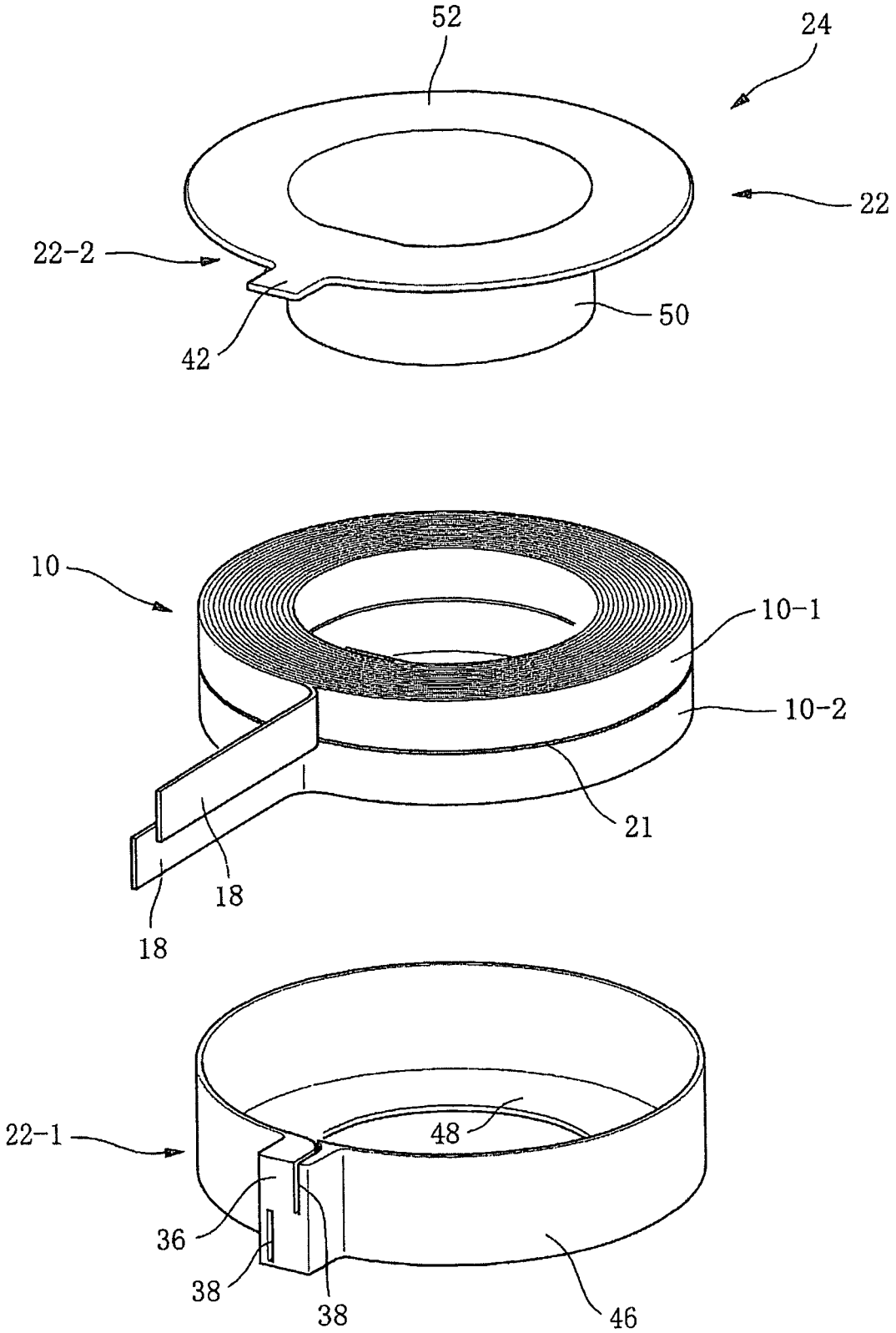
FIG. 4 is a perspective view in which the encased coil body of FIG. 3 is exploded into a resin covering layer and a coil, and illustrated.
Figure 5:
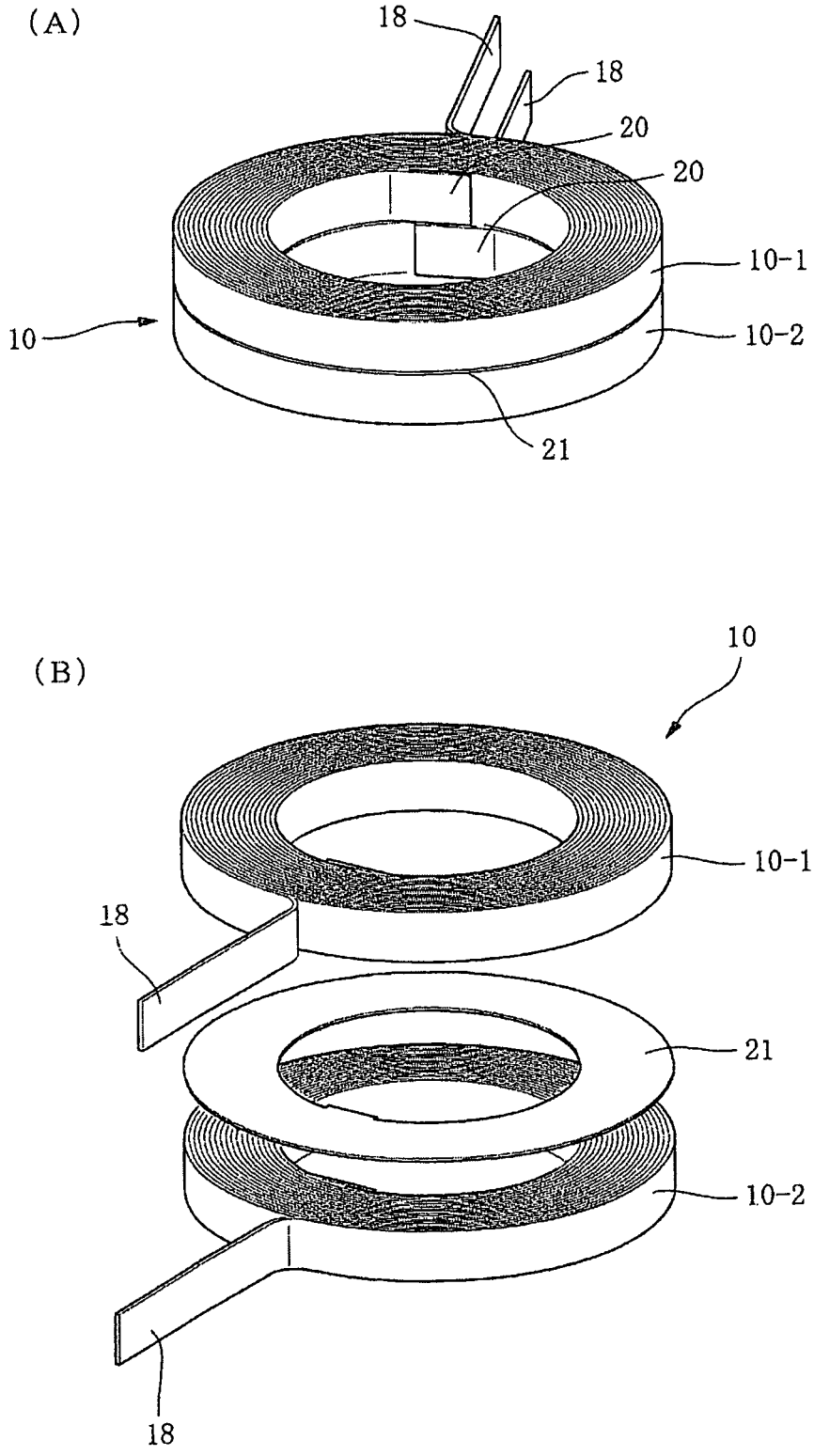
FIG. 5 describes a view when the coil of FIG. 4 is viewed from an angle other than that of FIG. 4 and a view in which the coil is exploded into an upper and lower coils and illustrated.

In the present embodiment, as shown in FIGS. 4 and 5, an upper coil block (hereinafter, simply referred to an upper coil) 10-1 and a lower coil block (hereinafter, simply referred to as a lower coil) 10-2 are superposed to each other in up and down directions so that the winding directions are opposite to each other, and ends 20 in each of the inner diameter sides are joined to each other, whereby the coil 10 is configured of a single continuous coil. However, the upper coil 10-1 and the lower coil 10-2 may be configured so as to be continuous by means of a single wire.

In addition, since a large electrical potential difference is generated between the upper coil 10-1 and the lower coil 10-2, as shown in FIG. 5(B), an annular insulating sheet 21 is interposed therebetween. Herein, the thickness of the insulating sheet 21 is approximately 0.5 mm.

Moreover, a reference number 18 in the drawings indicates coil terminals in the coil 10, and the coil terminals are formed so as to protrude outside in the radial direction.

As shown in FIG. 5(A), the upper coil 10-1 and the lower coil 10-2 have the same shape as each other, the planar shapes of both are an annular shape, and therefore, the entire coil 10 also has an annular shape.

Figure 2:
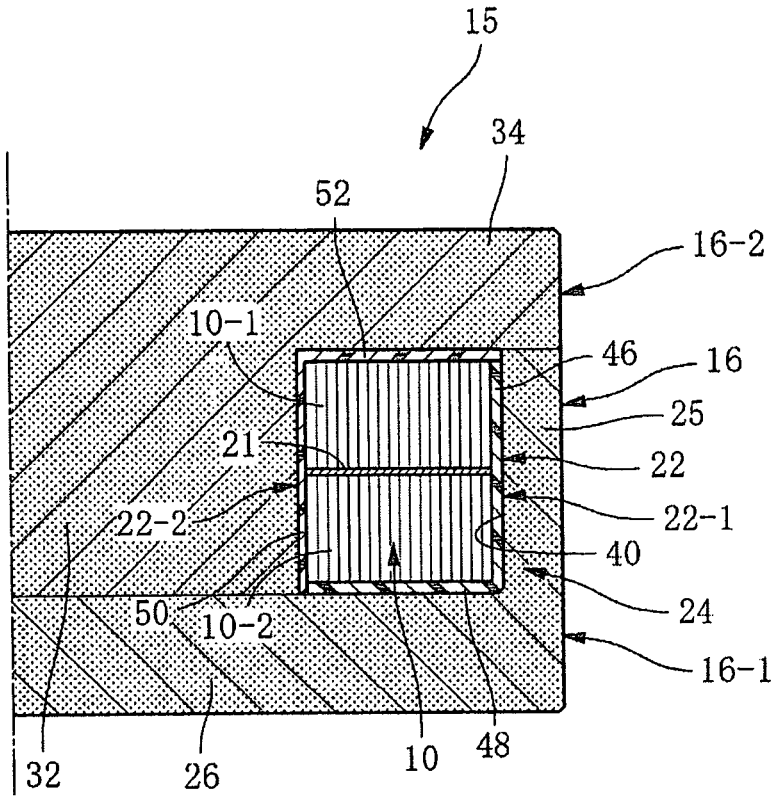
FIG. 2 is a main body cross-sectional view of the reactor in FIG. 1.

As shown in FIG. 2, the upper coil 10-1 and the lower coil 10-2 have the same vertical dimension along the coil axial direction.

Moreover, as shown in FIG. 1, the coil 10 is integrally included in the core 16 in a state of being entirely embedded in the core 16 except for a portion of the tip side of the coil terminal 18.

In this embodiment, various materials such as copper, aluminum, copper alloy, and aluminum alloy may be used for the coil 10 (Incidentally, the coil 10 is made of copper in this embodiment).

The coil 10 with attached insulating coating is entirely encased by an electrically insulating resin from the outside except for a portion of the tip side of the coil terminal 18.

Figure 3:
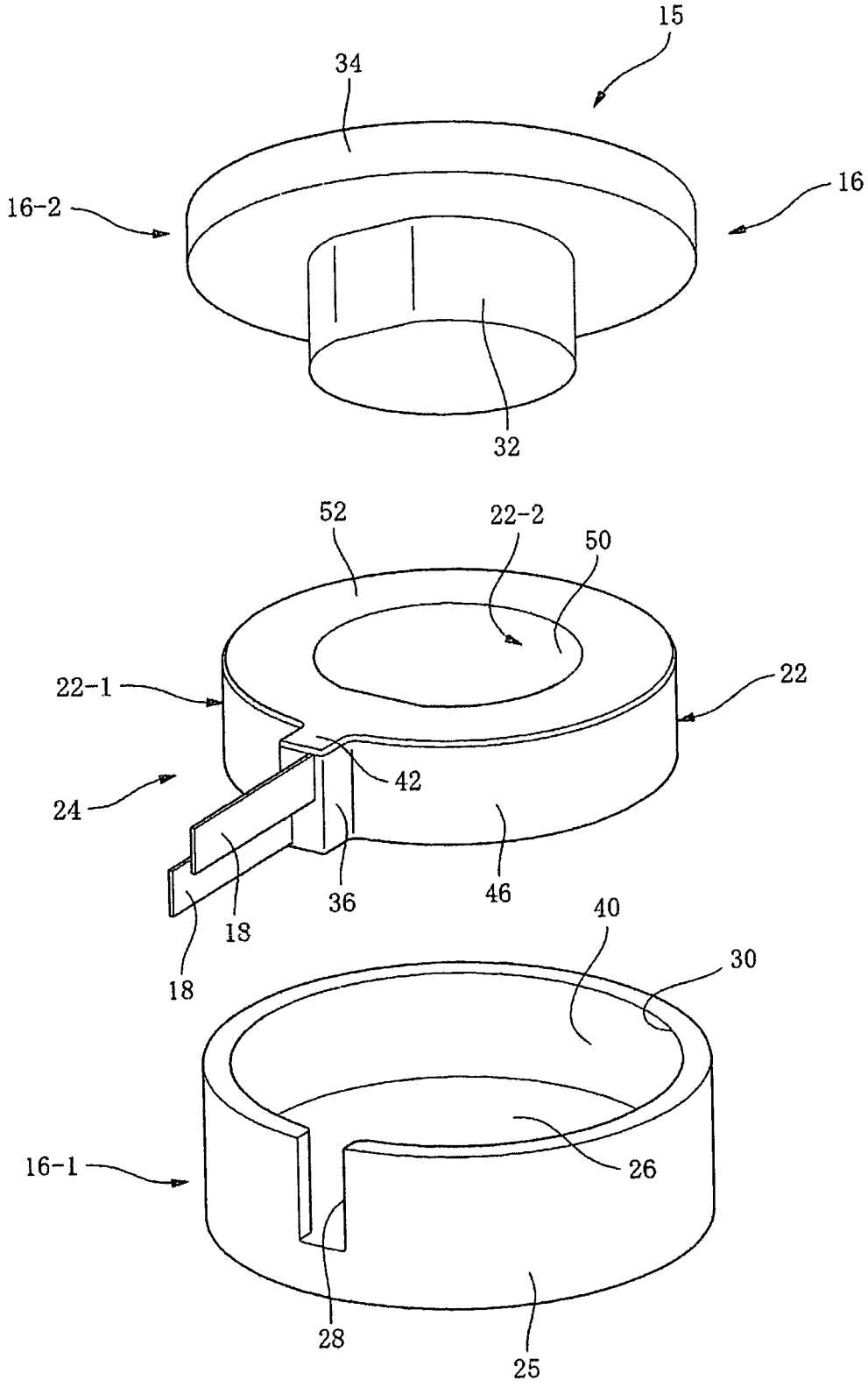
FIG. 3 is a perspective view in which the reactor of FIG. 1 is exploded and illustrated.

In FIGS. 1 and 3, a reference numeral 24 indicates the encased coil body which is configured of the coil 10 and the resin covering layer 22, in which the coil 10 is embedded in the inner portion of the core 16 as the encased coil body 24.

In this embodiment, it is preferable that the thickness of the resin covering layer 22 be 0.5 to 2.0 mm. The reasons therefor are as follows. In the case where the thickness thereof is smaller than 0.5 mm, the insulating coating has too low strength. In the case where the thickness thereof is larger than 2.0 mm, the magnetic circuit has too large a length, resulting in the necessity of enlarging the core accordingly.

The resin covering layer 22 is configured of an electrically insulating thermoplastic resin which does not contain a soft magnetic powder. As the thermoplastic resin, in addition to PPS, PA12, PA6, PA6T, POM, PE, PES, PVC, and EVA, other various materials may be used.

In this embodiment, the core 16 is configured of a molded body obtained by injection-molding a mixture (compound) obtained by mixing a soft magnetic powder with a resin binder including a thermoplastic resin and with a thermally conductive filler.

Also as shown in an exploded view of FIG. 3, a primary molded body 16-1 and a secondary molded body 16-2 are joined to each other using an injection-molding at a boundary surface $P_1$ shown in FIG. 1(B), so that the molded bodies are integrated to constitute the core 16.

As shown in FIGS. 1 to 3, the primary molded body 16-1 has a container-like shape that includes a cylindrical outer circumferential molded portion 25 which contacts the outer circumferential surface of the encased coil body 24 and a bottom portion 26 positioned at the lower side of the encased coil 24 in the drawings, in which an opening 30 is present at the upper end in a coil axis line direction in the drawings.

Moreover, a cutout portion 28 is provided on the outer circumferential molded portion 25 of the primary molded body 16-1.

The cutout portion 28 is one for inserting a thick portion 36 (refer to FIG. 3) of the encased coil body 24 described below.

On the other hand, also as shown in FIGS. 1 to 3, the secondary molded body 16-2 integrally includes an inner circumferential molded portion 32 which contacts the inner circumferential surface of the encased coil body 24, fills a blank space of the inner side of the coil 10, and reaches the bottom portion 26 in the primary molded body 16-1, and an upper circular cover portion 34 which is positioned upward from the encased coil body 24 in the drawings, closes the opening 30 of the primary molded body 16-1, and conceals a recess 40 of the primary molded body 16-1 and the encased coil body 24 accommodated in the recess in the inner portion.

On the other hand, as shown in an exploded view of FIG. 4, the resin covering layer 22 which encases the coil 10 is configured of a primary molded body 22-1 and a secondary molded body 22-2, and they are integrated with each other by joining through an injection-molding at a boundary surface $P_2$ shown in FIG. 1(B).

The primary molded body 22-1 integrally includes a cylindrical outer circumferential covering portion 46 which covers the outer circumferential surface of the coil 10 and a lower covering portion 48 which covers the entire lower end surface of the coil 10.

On the other hand, the secondary molded body 22-2 integrally includes a cylindrical inner circumferential covering portion 50 which covers the inner circumferential surface of the coil 10 and an upper covering portion 52 which covers the entire upper end surface of the coil 10.

Moreover, the thick portion 36 which protrudes outward in the radial direction is formed over the entire height in the primary molded body 22-1, and a pair of slits 38 which penetrates the thick portion in the radial direction is formed in the thick portion 36.

The pair of coil terminals 18 in the coil 10 penetrates the silts 38 and protrudes outward in the radial direction of the primary molded body 22-1.

In addition, a tongue-shaped protrusion 42 which protrudes outward in the radial direction is integrally formed with the upper covering portion 52 in the secondary molded body 22-2. The upper surface of the thick portion 36 in the primary molded body 22-1 is covered by the protrusion 42.

In FIGS. 3 to 10, a method of manufacture for the reactor 15 of FIG. 1 is specifically shown.

Figure 6:
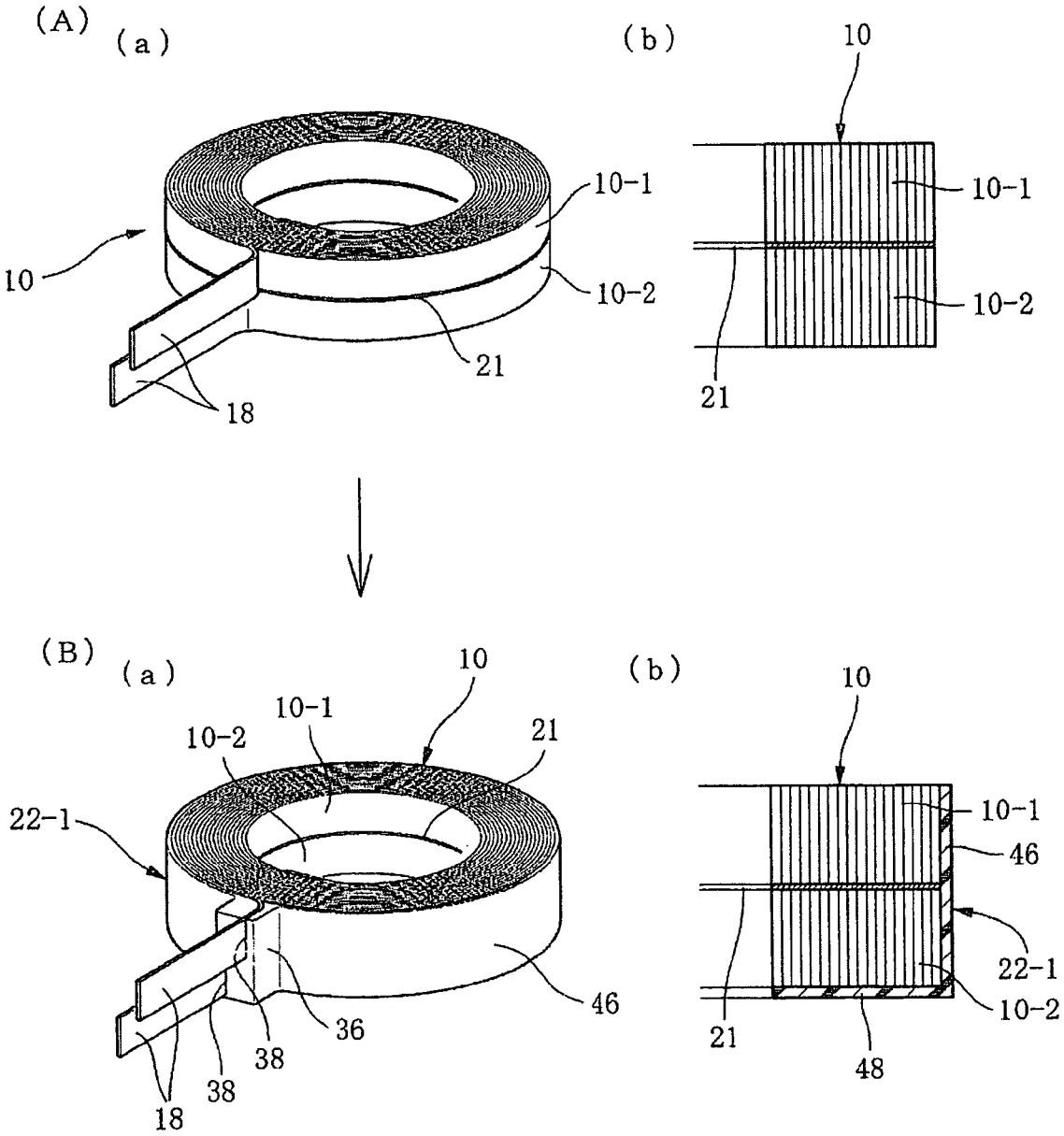
FIG. 6 describes explanatory views of a molding procedure of the encased coil body of the embodiment.
Figure 7:
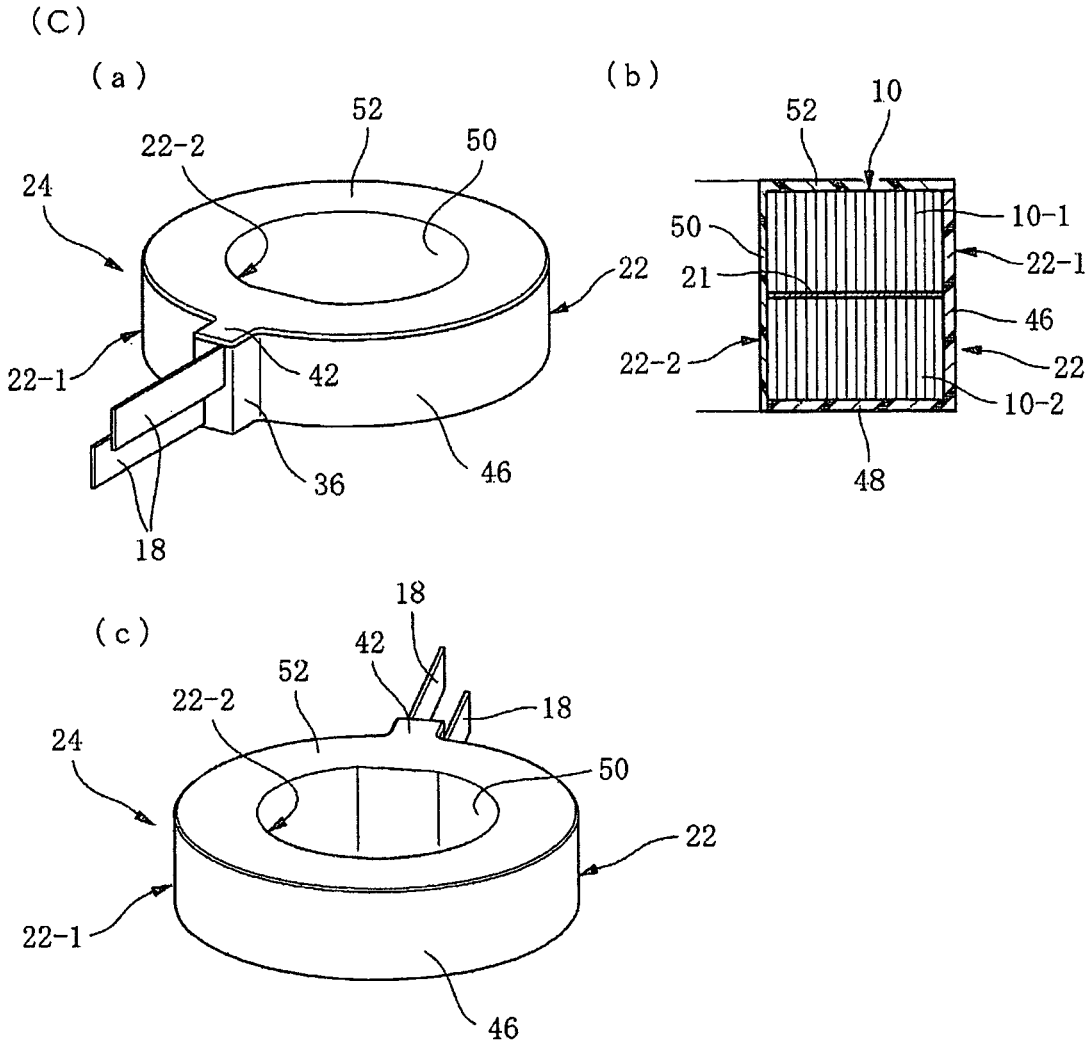
FIG. 7 describes an explanatory view of the molding procedure following FIG. 6.

In this embodiment, according to a procedure shown in FIGS. 6 and 7, the resin covering layer 22 is formed so as to enclose the coil 10 with attached insulating coating shown in FIG. 6(A) from the outside, and the encased coil body 24 is configured by integrating the coil 10 and the resin covering layer 22.

Herein, as shown in FIG. 6(B), the primary molded body 22-1 which integrally includes the outer circumferential covering portion 46 and the lower covering portion 48 is firstly molded, and thereafter, as shown in FIG. 7(C), the secondary molded body 22-2 which integrally includes the inner circumferential covering portion 50 and the upper covering portion 52 is molded, whereby the entire resin covering layer 22 is molded.

Figure 9:
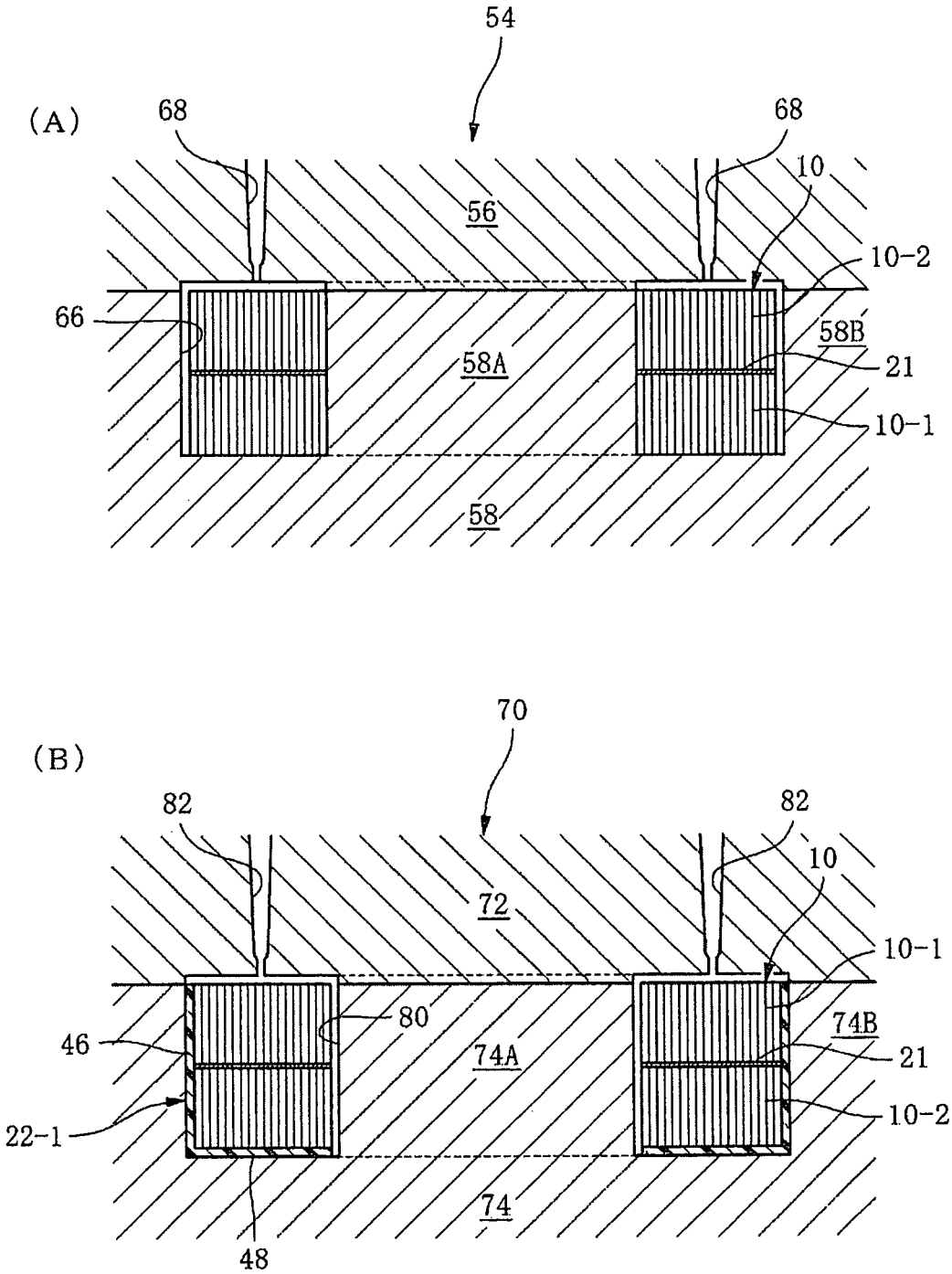
FIG. 9 shows explanatory views of a method of molding the encased coil body in the embodiment.

FIG. 9 shows a specific molding method at the time molding the entire resin covering layer.

In FIG. 9(A), a reference numeral 54 indicates a primary molding die for the encased coil body 24, specifically, for the resin covering layer 22, and the primary molding die includes an upper die 56 and a lower die 58.

Here, the lower die 58 includes a middle die portion 58A and an outer die portion 58B.

In a primary molding which uses the primary molding die 54 shown in FIG. 9(A), the coil 10 is firstly set to the primary molding die 54. At this time, the coil 10 is set so that the direction shown in FIG. 4 is turned upside down.

Specifically, the lower coil 10-2 is positioned at the upper side and the upper coil 10-1 is positioned at the lower side, so that the coil is set to the primary molding die 54 so as to be turned upside down.

Moreover, the middle die portion 58A is brought into contact with the inner circumferential surface of the coil 10, whereby the inner circumferential surface of the coil 10 is held so as to be restrained in the radial direction by the middle die portion 58A.

Then, a resin (thermoplastic resin) material is injected into a cavity 66, which is formed on the outer circumferential side of the coil 10 of the primary molding die 54, through a passage 68, and the primary molded body 22-1 of the resin covering layer 22 shown in FIGS. 1 and 6(B) is injection-molded.

Specifically, the primary molded body 22-1, which integrally includes the outer circumferential covering portion 46 and the lower covering portion 48 shown in FIG. 9(B), is injection-molded.

After the primary molded body 22-1 of the resin covering layer 22 is molded in this way, the primary molded body 22-1 is set to a secondary molding die 70 shown in FIG. 9(B) along with the coil 10 which is integrated with the primary molded body 22-1.

At this time, as shown in FIG. 9(B), the coil 10 is set to the secondary molding die 70 so as to be turned upside down along with the primary molded body 22-1.

The secondary molding die 70 includes an upper die 72 and a lower die 74. In addition, the lower die 74 includes a middle die portion 74A and an outer die portion 74B.

In a state where the secondary molding die 70 sets the primary molded body 22-1 along with the coil 10, a cavity 80 is formed on the inner circumferential side and the upper side of the coil.

In the secondary molding using the secondary molding die 70, the same resin material as the resin material at the time of the primary molding is injected into the cavity 80 through a passage 82, and the secondary molded body 22-2 in the resin covering layer 22 is injection-molded, and simultaneously, the secondary molded body is integrated with the primary molded body 22-1 and the coil 10.

In the present embodiment, the encased coil body 24 which is molded as mentioned above is integrated with the core 16 at the time of molding of the core 16 of FIG. 1.

Figure 8:
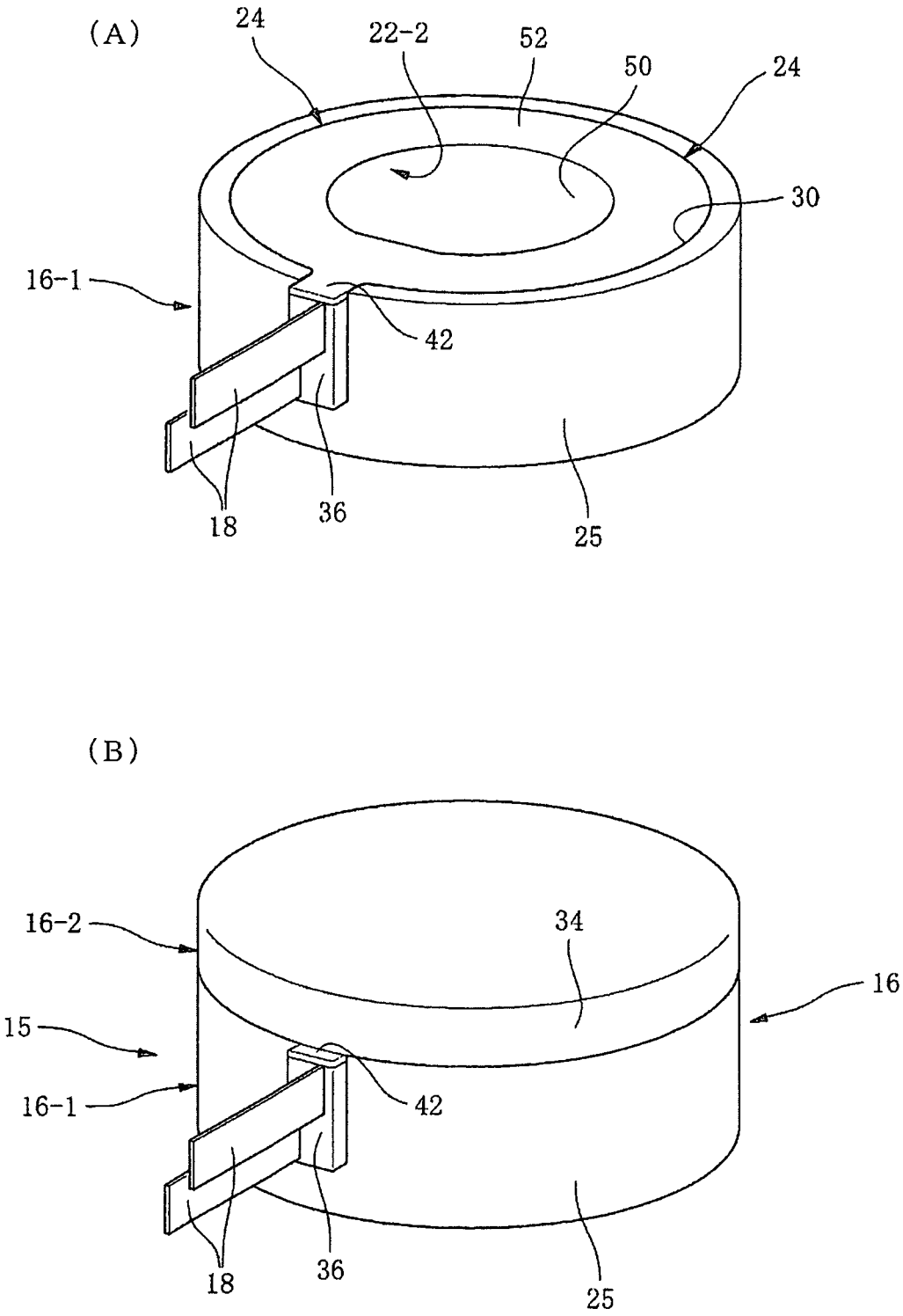
FIG. 8 describes process explanatory views of a method of manufacture for the reactor of the embodiment.
Figure 10:
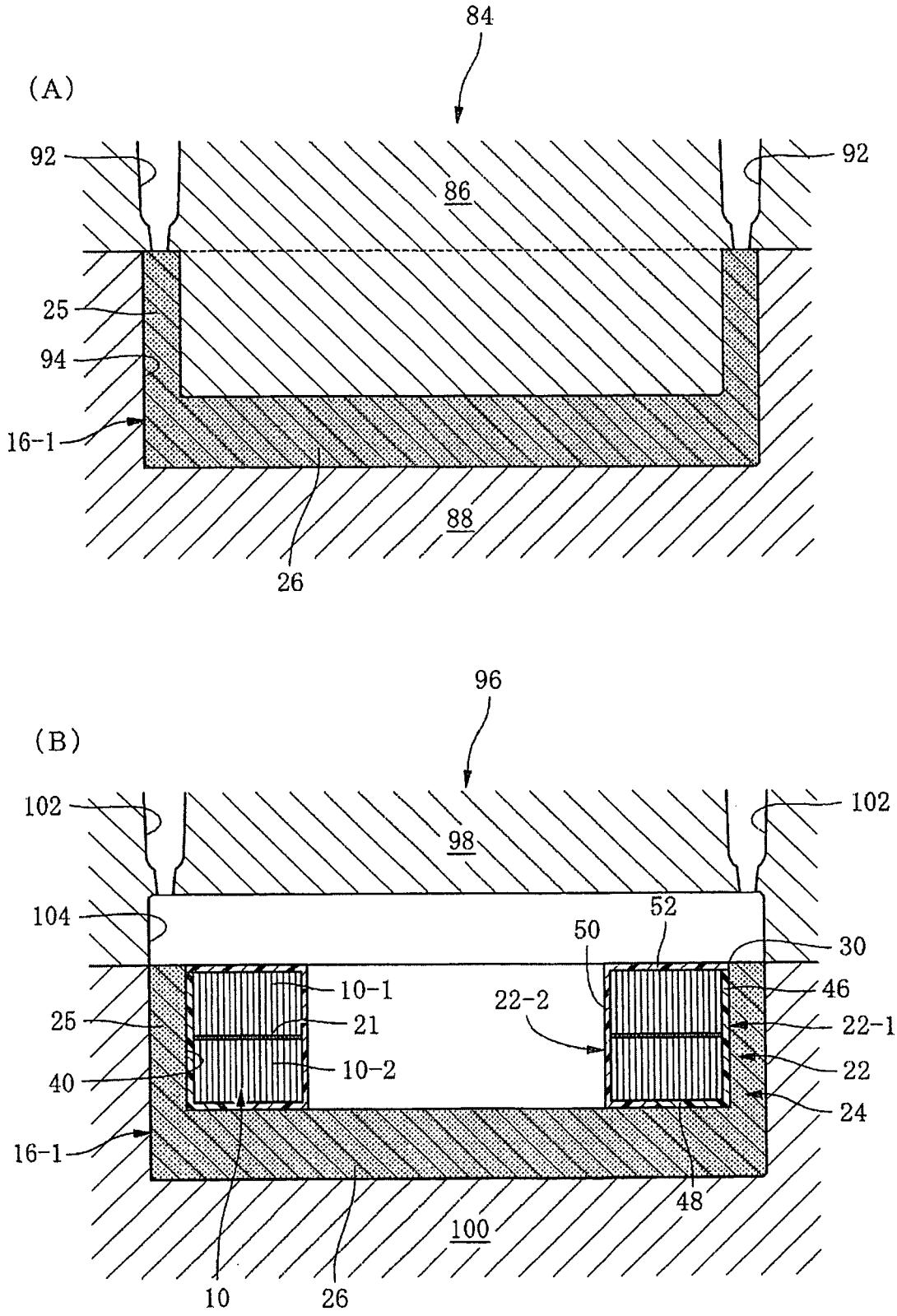
FIG. 10 shows explanatory views of a method of molding the core in the embodiment.

The specific procedures are illustrated in FIGS. 8 and 10.

In this embodiment, when the entire core 16 is molded, as shown in FIG. 8, the primary molded body 16-1 having a container shape is firstly molded in advance.

Thereafter, as shown in FIG. 8(A), the encased coil body 24 molded according to the procedure shown in FIGS. 6 and 7 is inserted into the inner portion of the recess 40 of the primary molded body 16-1 having a container shape over the entire height downward in the drawings through the opening 30 of the primary molded body 16-1, so that the encased coil body 24 is held by the primary molded body 16-1.

Moreover, in that state, the primary molded body 16-1 and the encased coil body 24 are set to the molding die, and the secondary molded body 16-2 in the core 16 is injection-molded so as to be integrated with the primary molded body 16-1 and the encased coil body 24.

FIG. 10(A) shows the primary molding die for the core 16 which molds the primary molded body 16-1.

A reference numeral 84 indicates the primary molding die which molds the primary molded body 16-1 and includes an upper die 86 and a lower die 88.

Here, the mixture (compound) of the soft magnetic powder and the resin binder is injection-molded to a cavity 94 through a passage 92, whereby the primary molded body 16-1 which integrally includes the outer circumferential molded portion 25 and the bottom portion 26 is molded.

FIG. 10(B) shows the secondary molding die which molds the secondary molded body 16-2 in the core 16.

A reference numeral 96 indicates the secondary molding die and includes an upper die 98 and a lower die 100.

In the secondary molding, the encased coil body 24 is firstly inserted into the molded primary molded body 16-1, and in a state of being held, these are set to the secondary molding die 96.

At this time, the outer circumferential surface of the primary molded body 16-1 contacts the entire circumference of the secondary molding die 96, and therefore, the primary molded body 16-1 is positioned in the radial direction. In addition, the lower surface of the bottom portion 26 is held in the state of being positioned in up and down directions in the secondary molding die 96.

That is, the encased coil body 24 is held so as to be positioned not only in the radial direction but also in the up and down directions in the secondary molding die 96 via the primary molded body 16-1.

In the secondary molding, in that state, the same mixture as that used at the time of the primary molding is injected into a cavity 104 through a passage 102 disposed further upward than the cavity 104 in the drawings, whereby the secondary molded body 16-2 of FIGS. 1(B), 3 and, 8(B) is molded, and simultaneously, the secondary molded body 16-2 is integrated with the primary molded body 16-1 and the encased coil body 24.

Here, the reactor 15 shown in FIGS. 1 and 8(B) is obtained.

In the embodiment described above, the mixture of a soft magnetic powder and thermoplastic resins is injected, while the coil 10 covered with an insulating coating is kept in the state of being encased in and protected by the resin covering layer 22, thereby molding the core 16. Consequently, during the injection, the soft magnetic powder such as an iron powder, contained in the mixture is not struck hard or rubbed against the insulating coating of the coil 10. It is therefore possible to effectively prevent the trouble that during the molding of the core 16, the soft magnetic powder strikes on the insulating coating of the coil 10 to thereby damage the insulating coating.

Moreover, since the resin covering layer 22 is present as a protective layer or a buffer layer between the core 16 and the insulating coating of the coil 10, heat stress due to the expansion and shrinkage of the core 16 does not directly act on the insulating coating and, hence, the problem of the damage of the insulating coating due to the heat stress can be solved.

In addition, since the coil 10 has been integrated with the resin covering layer 22 to configure the encased coil body 24, the coil 10 can be satisfactorily prevented from deforming when the core 16 is injection-molded.

Furthermore, in this embodiment, since the outer circumferential molded portion 25 in the core 16 is molded alone as a primary molded body 16-1 in advance separately from the coil 10, the production process is free from the problem in which during the molding of the core 16, the outer circumferential molded portion 25 cracks due to the coil 10 located inside the core 16.

Moreover, the secondary molded body 16-2 of the core is molded in the state where the encased coil body 24, that is, the coil 10 is held so as to be positioned in the secondary molding die 96 for the core 16 via the primary molded body 16-1. Accordingly, at this time; the positional misalignment of the coil 10 from the set position due to the injection pressure and the flow pressure can be prevented, and the molding of the core 16 can be completed in the state where the coil 10 is precisely positioned at the previously-set position and held.

Accordingly, it is possible to favorably prevent the characteristics of the reactor 15 from being subjected to adverse effects due to the positional misalignment of the coil 10 at the time of molding the core 16.

Furthermore, in the present embodiment, when the resin covering layer 22 of the encased coil body 24 is injection-molded, since the molding is performed so as to be divided into at least twice, the molding can be performed in the state where the coil 10 is held so as to be favorably positioned by the molding die, and it is thus possible to favorably prevent the positional misalignment or the deformation of the coil 10 due to the injection pressure or the flow pressure at the time of the molding.

(Embodiment 2: Embodiments of Reactor Produced by Potting)

Figure 13:
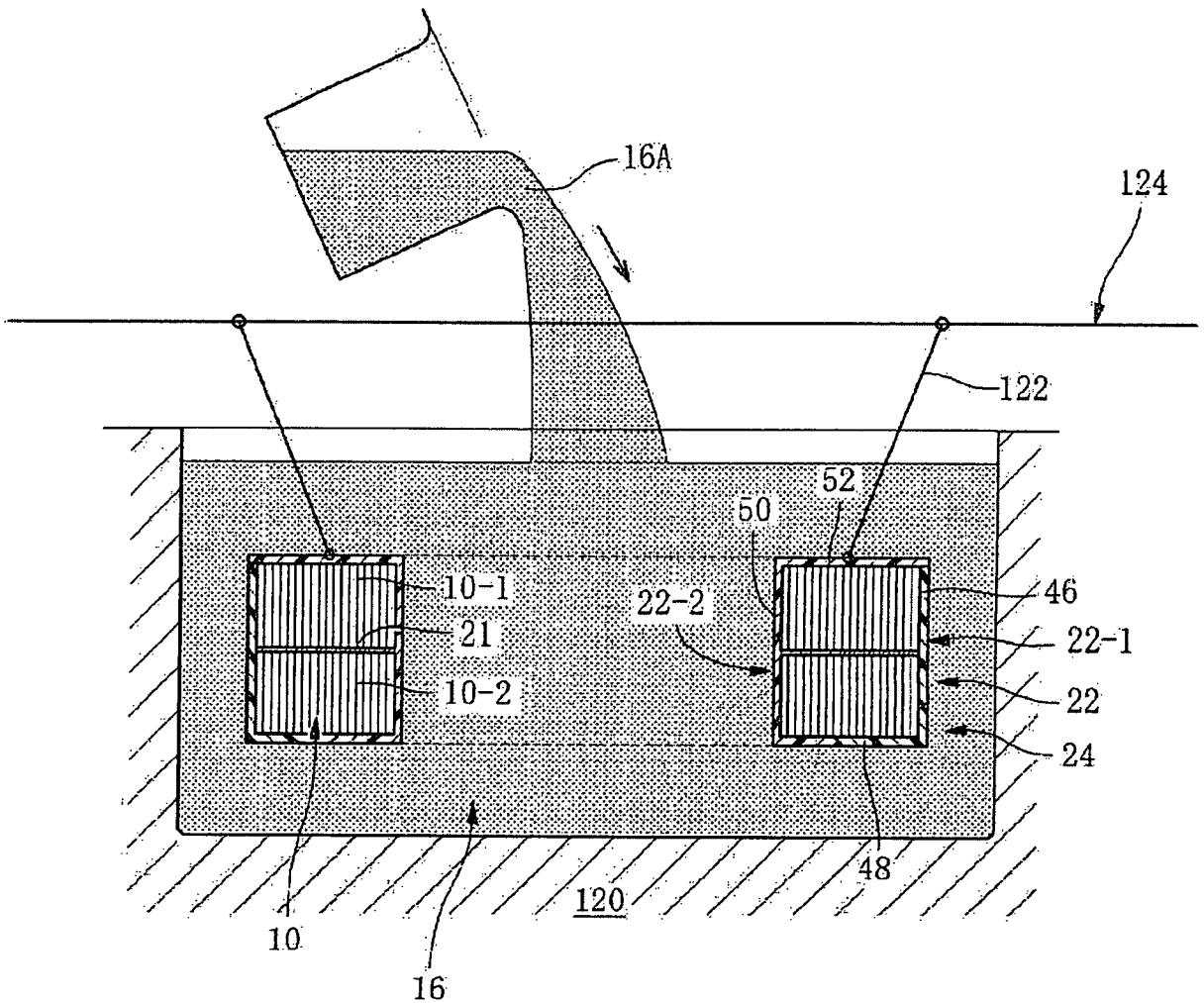
FIG. 13 shows a view illustrating a method for molding a core in another embodiment of the invention.

The reactor produced by potting, which is another embodiment, is explained by reference to FIG. 13.

A coil 10 is prepared beforehand as an encased coil body 24 in which the coil 10 has been integrated with a resin covering layer 22, by the method described above with regard to Embodiment 1.

Here, one end of each of suspension fibers 122 is fixed to the coil 10 (specifically, the encased coil body 24), and a holder 124 is passed through the other ends of the suspension fibers 122. This holder 124 is fixed to a potting case 120, thereby holding the coil 10 in the state of being suspended in the potting case 120. Here, the coil 10 is suspended at least three positions and these positions for suspension are evenly arranged so that the coil 10 can be stably suspended and held.

The fixing of each suspension fiber 122 to the coil 10 may be accomplished by knotting the suspension fibers 122 to form rings so that the coil 10 pierces the rings or by fixing the suspension fibers 122 using an adhesive.

Incidentally, the positions and lengths of the suspension fibers 122 and holder 124 are regulated in advance so that the coil 10 is disposed in a given position in the potting case 120.

The suspension fibers 122 are not limited so long as the suspension fibers have strength and durability which enable the suspension fibers to withstand the injection and thermal curing of a slurry 16A. Thin fibers of a polyamide or polyimide (diameter, 0.5 mm or less) are suitable.

Next, a liquid mixture (slurry 16A) including a soft magnetic powder, a resin binder, and a thermally conductive filler is injected into the potting case 120 in which the coil 10 is held, while embedding the coil 10. This potting case 120 which contains the slurry 16A is introduced into a heating furnace to cure the resin binder.

After the curing, the molded body is taken out of the potting case 120 to obtain a reactor 15. The suspension fibers 122 protruding from this reactor 15 are cut at the reactor surface.

EXAMPLES

The mixing ratio of a soft magnetic powder in the core 16 of a reactor 15 and the mixing and mixing ratio of a thermally conductive fibrous filler were changed, and the effects of the changes, specifically the effects thereof on heating temperature (effect of inhibiting temperature rising due to heat generation), were examined together with effects thereof on other various properties.

First, the mixing ratio of a soft magnetic powder was changed while keeping the mixing ratio of a thermally conductive filler constant, as shown in Table 1, and the effects thereof were examined.

(a) Configuration of Reactor

In each of the Examples and Comparative Examples shown in Table 1, the following ingredients were used for the core 16: a soft magnetic powder having the composition Fe-6.5Si (% by mass) was used; a PPS resin was used as a thermoplastic resin in the resin binder (here, a 200 μm pulverized powder of linear PPS resin; product name H-1G; manufactured by DIC Corp. was used); and carbon fibers were used as a thermally conductive filler.

However, the carbon fibers used here are ones having a thermal conductivity as extremely high as 450 (W/m·K) or above (which is higher than that of metallic Ag).

Specifically, carbon fibers marketed by Teijin Ltd. under the trade name of "Raheama" (grade, R-A201) were used. The carbon fibers have an average fiber diameter of 8 μm, an average fiber length of 50 μm, and a thermal conductivity as extremely high as 600 (W/m·K).

The carbon fibers are carbon fibers having extremely high crystallinity (degree of graphitization) and are tubular short fibers obtained by cutting fibrous graphite into a length of tens of micrometers.

Additionally, as the similar things, carbon fibers which are similar to those and commercially available under the trade name of "DIALEAD" (grade, K223HM), manufactured by Mitsubishi Plastics Industries Ltd. may be used.

There is "DIALEAD" K6371M, as a grade different from those grades, which has a slightly reduced graphite crystallinity. This grade has a thermal conductivity of about 150 (W/m·K) but has an electrical resistance of 6 to 7 (μΩ·m). In view of the fact that carbon fibers having a high crystallinity ("Raheama" R-A201 and "DIALEAD" K223HM) have an electrical resistance of 2 (μΩ·m) or less, the electrical resistance of the carbon fibers of that grade is several times.

For reasons of convenience, carbon fibers having a high graphite crystallinity, that is, carbon fibers of the grade having a thermal conductivity of about 600 (W/m·K) and an electrical resistance of 2 (gam) or less (e.g., "Raheama" R-A201 and "DIALEAD" K223HM), are hereinafter referred to as "CF1", and carbon fibers having a slightly low graphite crystallinity, that is, carbon fibers of the grade having a thermal conductivity of about 150 (W/m·K) and an electrical resistance of 6 to 7 (μΩ·m) (e.g., "DIALEAD" K6371M), are hereinafter referred to as "CF2".

Such grades can be used in the following manner: in the case where heating temperature is desired to be lowered, carbon fibers "CF1" are preferentially used; and in the case where loss (eddy current loss) is desired to be reduced, carbon fibers "CF2" are preferentially used. In cases where intermediate properties are required, it is possible to use a mixture of these two grades.

The soft magnetic powder used was a gas-atomized powder obtained by atomization with argon gas. The powder was heat-treated in hydrogen at 750° C. for 3 hours for the purposes of oxidation prevention and reduction.

On the supposition of use of the core in an alternating magnetic field of 1 to 50 kHz, the soft magnetic powder after the heat treatment was sieved to recover 250 μm and smaller particles before use.

This soft magnetic powder was mixed with a thermally conductive filler and a resin binder in each of the various mixing ratios shown in Table 1 and kneaded with a twin-screw kneader together with the resin binder, etc. melted at about 300° C., and the mixture was pelletized to prepare a compound.

Using a horizontal in-line screw type injection molding machine, the compound was heated at about 300° C. and brought into a molten state and was then injected into a die preheated at 150° C. The die was cooled to mold a core 16.

A coil 10 was produced in the following manner. A rectangular pure-copper wire (wire dimensions: thickness, 0.85 mm; width, 9 mm) coated with an insulating coating made of a polyamide-imide resin (thickness of the coating, 20 to 30 μm) was flat-wise wound to produce an upper coil 10-1 and a lower coil 10-2. These coils were superposed in vertical two stages, and the inside ends 20 thereof were connected to each other. This joint was insulated again with a polyimide tape.

The upper coil 10-1 and the lower coil 10-2 were superposed in the manner shown in FIG. 5(B). That is, the upper coil 10-1 was inverted and superposed on the lower coil 10-2 so that current flowed in the same rotational direction during voltage application.

With respect to dimensions, each coil had an inner diameter of ϕ47 mm. The number of turns was 18 in each of the lower coil 10-2 and the upper coil 10-1, the total number of turns being 36.

An insulating sheet 21 having a thickness of 0.5 mm was interposed between the upper coil 10-1 and the lower coil 10-2.

The core 16 has been configured so that the coil 10 was enclosed therein in an embedded state without an interval, and has such dimensions that the outer diameter of the core is ϕ90 mm and the core height is 40.5 mm.

The core 16 and the coil 10 have been disposed so that the axis of the core 16 coincides with the axis of the coil 10 and that the axial-direction center of the core 16 coincides with the axial-direction center of the coil 10.

(b) Evaluation Methods

Figure 11:
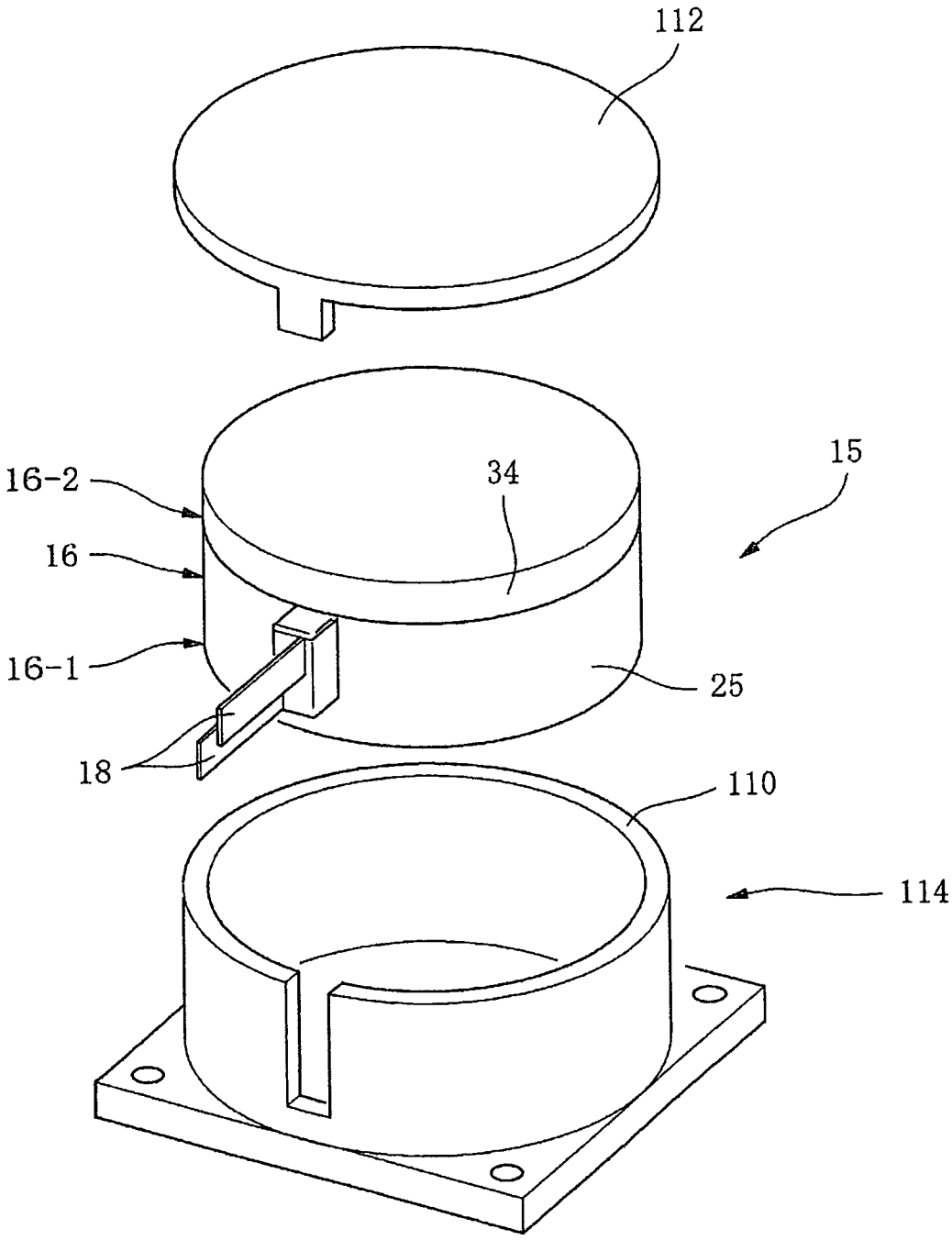
FIG. 11 shows an explanatory view for illustrating a test method for evaluating properties of a core.

The properties shown in Table 1 which are inductance, loss, and heating temperature were evaluated while keeping the reactor 15 housed in the aluminum case (reactor case) 114 shown in FIG. 11 which included a container portion 110 and a cover portion 112.

The aluminum case 114 had a wall thickness of 5 mm.

Fixing between the aluminum case 114 and the reactor 115 was made with a silicone resin.

(c) Measurement of Inductance

Inductance was measured in the following manner. The reactor 15 placed in the aluminum case 114 was incorporated into a boosting chopper circuit. A given superimposed current was caused to flow at an input voltage of 300 V, a voltage after boosting of 600 V, and a switching frequency of 10 kHz to operate the circuit. The current which flowed through the reactor was examined for waveform (the current was measured with a clamp type ammeter attached to one of the terminals), and the inductance was calculated from the inclination of the current waveform observed in a given time period.

(d) Measurement of Heating Temperature and Loss

Heating temperature and loss were measured by the following method.

The reactor 15 placed in the aluminum case 114 was fixed to a water-cooled plate. At this time, a heat conduction grease was thinly spread between the water-cooled plate and the aluminum case 114.

At a superimposed current of 0 A, the reactor was operated from 300 V to 600 V under the conditions of 10 kHz using the same boosting chopper circuit as in the inductance measurement and was continuously operated until the reactor came into a thermally steady state (the state where the internal temperature of the core and the temperature of the cooling water did not change with time). The cooling water was controlled so as to have a temperature of 50° C. and flow at 10 liters per minute, with a chiller (constant-temperature-water circulator).

Figure 12:
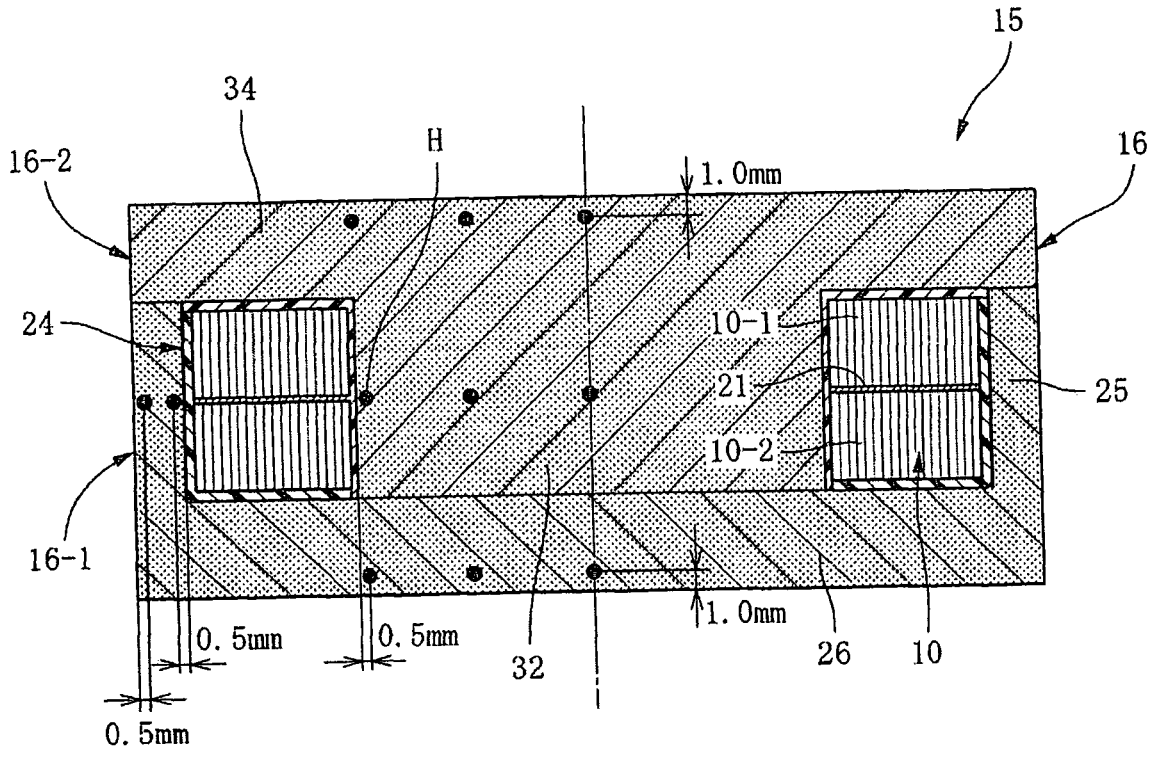
FIG. 12 shows a view illustrating the positions of points where the temperature of the core was measured.

The inner temperature of the core was measured in this operation at several positions, and the highest of the measured temperatures was taken as the internal temperature (heating temperature). The positions where the temperature measurement was made were the eleven positions shown in FIG. 12, and thermocouples were embedded therein to make the measurement. However, the eleven measuring points were disposed not in the same cross-section but in positions slightly shifted along the circumferential direction, in order to avoid influences of the embedding of adjacent points.

A quantity of heat was determined from the flow rate of the cooling water flowing through the water-cooled plate and from the difference in temperature between the inlet side and the outlet side, and this quantity of heat was taken as the loss.

Here, the loss occurring at a superimposed current of 0 A is divided according to factor into the following.

Loss due to the loss of the core material (sum of hysteresis loss and eddy current loss) (core loss).

Loss due to the heat generation by the coil that corresponds to the amplitude of the current obtained by subtracting the superimposed direct current from the current flowing through the reactor (alternating copper loss).

Loss due to the skin effect that is produced when high-frequency current flows through the wire of the coil (skin effect loss).

Loss due to the proximity effect whereby adjacent wires mutually inhibit the current flow within the other (proximity effect loss).

Since accurate division into these losses is difficult, the losses occurring at a superimposed current of 0 A are directly compared in Table 1 (and in Table 2 also).

The smaller the loss occurring in a reactor, the more the reactor is desirable of course. However, an increase in cost may result therefrom, and such reactors have a poor commercial value. Consequently, desired loss characteristics are determined from a balance between the reactor and other parts within the booster circuit or entire inverter system. Here, the loss of the reactor alone was set at 100 W or less as a desired value.

Meanwhile, the heating temperature is determined from the allowable temperatures and long-term durability of the materials used in the reactor and from the environment (in particular, cooling conditions) in which the reactor is used. Although the temperature of the cooling water was set at 50° C. in this examination, there are cases where this temperature is too high or too low, depending on the system used. The temperature of 50° C. was employed here as an approximately average temperature. Furthermore, there are various permissible temperature increases. However, since an increase of 65° C. is common, this value was employed. Consequently, a desired value of the heating temperature was set at 115° C.

(e) Flowability

The flowability shown in Table 1 is the flowability of compounds. This flowability was evaluated in accordance with JIS K 7210, method B by measuring the following sampling time t under the following conditions and determining the following MVR.

Test load: 10 kg

Temperature: 315° C.

Heating time: 6 min

Sampling time t: Time required for the piston to move over a distance of L was measured (L=25 mm).

$MVR(cm^3/10\ min)=427\times L/t$ sure to the high temperature were alternately repeated to perform 1,000 cycles. The period of each exposure was 2 hours.

(b) [Evaluation Criteria]: After the 1,000 cycles, (i) the reactor has an appearance with no cracks; (ii) the reactor is capable of clearing the withstand voltage test again; and (iii) the change in inductance through the thermal shock test is 5% or less.

(c) [Test Device]: Type TSA-41L-A, manufactured by ESPEC Corp.

TABLE 1

Results of measurements of various properties

| | X | Y | Flowability ($cm^3$/10 min) | Inductance (μH) | Loss (W) | Heating temperature (° C.) |
|---|---|---|---|---|---|---|
| | | | Desired value | | | |
| | (% by mass) | (% by mass) | 100 or higher | 300 or higher | 100 or lower | 115 or lower |
| Comparative Example 1 | 82.63 | 1.0 | 615 | 280 (unacceptable) | 90 | 120 (unacceptable) |
| Example 1 | 84.90 | 1.0 | 438 | 310 | 85 | 110 |
| Example 2 | 91.23 | 1.0 | 271 | 400 | 60 | 100 |
| Example 3 | 95.88 | 1.0 | 102 | 490 | 50 | 95 |
| Comparative Example 2 | 97.31 | 1.0 | 81 (unacceptable) | 520 | 40 | 80 |

The results of those measurements are summarized in Table 1.

It is desirable that the flowability should be 100 ($cm^3$/10 min) or higher when manufacturability is taken into account, and that value was set as a desired value. In the case where the flowability is lower than that value, this compound may come not to flow during injection molding, resulting in defective products, or may give molded articles which have a roughened surface and a reduced commercial value. It is more desirable that the flowability should be 200 ($cm^3$/10 min) or higher, from the standpoint that such compounds can be molded at a reduced molding pressure and can give molded articles having a surface in a highly satisfactory state.

<Withstand Voltage Measurement>

Withstand voltage was measured in the following manner.

Here, the reactor 15 was directly disposed on an aluminum base plate to bring the reactor 15 into the state of being electrically connected to the aluminum base plate. One of the terminals of a measuring device was connected to one coil terminal 18 of the reactor 15, and the other terminal was connected to the aluminum base plate.

Voltage application to the reactor 15 in this state was conducted so that the voltage was gradually increased from alternating current 0 V to 3,500 V (volts) and kept at 3,500 V for 1 second.

Withstand voltage was assessed based on the following criteria: the reactor was rated as acceptable or unacceptable when the current which flowed therethrough during the voltage application was up to 10 mA (milliamperes) or higher than that, respectively.

<Thermal Shock Test>

A thermal shock test was performed in the following manner.

(a) [Test Method]: The following thermal shock test device was used, and the low-temperature chamber and the high-temperature chamber were kept at −40° C. and 150° C., respectively. Exposure to the low temperature and expo- The results shown in Table 1 are results obtained using the "CF1" as carbon fibers.

Among the results in Table 1, Comparative Example 1 shows satisfactory flowability but has an insufficient value of inductance, as a magnetic property, as compared with the desired value, since the amount of the soft magnetic powder was insufficient. Furthermore, the heating temperature thereof is high because of the insufficient amount of the soft magnetic powder. The value of loss also is large.

In contrast, as the amount of the soft magnetic powder was increased as in Examples 1 to 3, the inductance as a magnetic property increased. In addition, since the amount of the resin binder became relatively smaller and the amount of the soft magnetic powder, which has a higher thermal conductivity than the resin binder, increased, these Examples each have a lowered heating temperature and a reduced loss.

It is, however, noted that the value of flowability became smaller as the amount of the soft magnetic powder increased. In Comparative Example 2, in which the amount of the soft magnetic powder was larger than 96% (% by mass; the same applies hereinafter), the value of flowability is below the desired value. Compounds having poor flowability, such as that of Comparative Example 2, are substantially unsuitable for mass production.

As shown in Table 1, satisfactory results concerning all of heating temperature, loss, inductance, and flowability were obtained in Examples 1 to 3, in which the mixing ratio of the soft magnetic powder was in the range of 83 to 96%, with the mixing ratio of the thermally conductive filler being 1%.

Next, various properties including heating temperature were evaluated under such conditions that the mixing ratio of the soft magnetic powder was fixed at 91.23% as shown in Table 2 and the mixing ratio of the thermally conductive filler was variously changed.

The results thereof are inclusively shown in Table 2.

Incidentally, the conditions other than the mixing ratio of the soft magnetic powder and than the mixing ratio of the thermally conductive filler were the same as the conditions used for the evaluation shown in Table 1.

TABLE 2

| Results of measurements of various properties | | | | | | |
|---|---|---|---|---|---|---|
| | X | Y | Flowability ($cm^3$/10 min) | Inductance (μH) | Loss (W) | Heating temperature (° C.) |
| | | | Desired value | | | |
| | (% by mass) | (% by mass) | 100 or higher | 300 or higher | 100 or lower | 115 or lower |
| Comparative Example 3 | 91.23 | 0 | 290 | 400 | 50 | 125 (unacceptable) |
| Example 4 | 91.23 | 0.2 | 285 | 400 | 52 | 115 |
| Example 5 | 91.23 | 0.5 | 280 | 400 | 55 | 108 |
| Example 6 | 91.23 | 1.0 | 271 | 400 | 60 | 100 |
| Example 7 | 91.23 | 2.0 | 210 | 400 | 75 | 102 |
| Example 8 | 91.23 | 2.8 | 106 | 400 | 100 | 115 |

The results given in Table 2 show the following. As the mixing ratio of the carbon fibers incorporated as a thermally conductive filler is increased to 1.0% (% by mass; the same applied hereinafter), the heating temperature is effectively lowered while keeping the inductance characteristics and loss characteristics substantially unchanged (Examples 4 to 6).

As the mixing ratio of the carbon fibers as a thermally conductive filler is further increased beyond that level, the values of heating temperature and loss come to increase, rather than decrease. In cases when the mixing ratio thereof is increased to above 2.8%, the values of heating temperature and loss exceed the desired values.

The reason why the values of heating temperature and loss thus increase, rather than decrease, as the mixing ratio of carbon fibers is increased beyond a certain level is that the eddy current which occurs in the carbon fibers is enhanced.

In the case where the loss due to eddy current thus increases, the efficiency of the reactor 15 or of a device connected thereto decreases.

Among the results in Table 2, the reactor which is the lowest in heating temperature is that of Example 6, in which the mixing ratio of carbon fibers is 1.0%. The heating temperature is bottom at that mixing ratio, and becomes higher in cases when the mixing ratio of carbon fibers is either smaller or larger than that value.

Namely, in the case where carbon fibers are used as a thermally conductive filler, there is a proper range of mixing ratios thereof which lies on both sides of the bottom as the center of the range.

In cases when the addition amount of the soft magnetic powder is that shown in Table 2 (specifically, the addition amount thereof is in the range of 91 to 93%), it is desirable that the addition amount of the thermally conductive filler should be regulated so as to be in the range of 0.2 to 2.8%, from the standpoints of reducing heating temperature and loss and keeping the value of flowability, which decreases due to the addition of the thermally conductive filler, at or above a certain level. It is more desirable that the addition amount thereof should be in the range of 0.5 to 1.5%, which is a more proper range.

Next, various properties including heating temperature were evaluated under such conditions that as shown in Table 3, the mixing ratio of the soft magnetic powder was fixed at 84.90%, which was smaller than the mixing ratio shown in Table 2, and carbon fibers "CF2" were used as the material of thermally conductive filler in various mixing ratios.

The results thereof are inclusively shown in Table 3.

Incidentally, the conditions other than the mixing ratios of the soft magnetic powder and thermally conductive filler and than the material of thermally conductive filler were the same as the conditions used for the evaluation shown in Table 1.

TABLE 3

| Results of measurements of various properties | | | | | | |
|---|---|---|---|---|---|---|
| | X | Y | Flowability ($cm^3$/10 min) | Inductance (μH) | Loss (W) | Heating temperature (° C.) |
| | | | Desired value | | | |
| | (% by mass) | (% by mass) | 100 or higher | 300 or higher | 100 or lower | 115 or lower |
| Example 9 | 84.90 | 1.0 | 438 | 310 | 78 | 115 |
| Example 10 | 84.90 | 4.5 | 322 | 310 | 84 | 100 |
| Example 11 | 84.90 | 6.8 | 250 | 310 | 92 | 113 |
| Comparative Example 4 | 84.90 | 8.0 | 200 | 310 | 114 (unacceptable) | 120 (unacceptable) |

The results given in Table 3 show the following. Since the proportion of the soft magnetic powder was smaller than in Table 2, the flowability is higher than the desired value even when the proportion of the thermally conductive filler was increased beyond the upper limit (Example 8) shown in Table 2. The flowability is not on a level which is problematic in mass production.

The inductance has decreased since the proportion of the soft magnetic powder was smaller than that shown in Table 2, but satisfies the desired value.

Example 9 shows a reduced loss and a slightly elevated heating temperature as compared with Example 1 because of the change of the material of carbon fibers as a thermally conductive filler (i.e., because of a decrease in thermal conductivity and an increase in electrical conductivity) even through the mixing ratio of the thermally conductive filler was 1.0% (% by mass; the same applies hereinafter) and was the same as in Example 1. However, the loss and the heating temperature both satisfy the desired values.

As the mixing ratio of the thermally conductive filler is increased from 1.0% to 4.5%, 6.8%, and 8.0% as in Examples 9, 10, and 11 and Comparative Example 4, the heating temperature is effectively lowered in cases when the mixing ratio thereof is up to 4.5%, while substantially maintaining the loss. In cases when the proportion of the thermally conductive filler is further increased beyond 4.5%, the heating temperature comes to rise, rather than decline. In cases when the mixing ratio thereof is increased beyond 6.8% and to 8.0%, both the loss and the heating temperature become unable to satisfy the desired values.

As described above, the heating temperature in the results given in Table 3 rises as the mixing ratio of the carbon fibers is increased from a certain level, as in the results shown in Table 2. The reason therefor is that the loss due to the eddy current which occurs in the carbon fibers is larger than the quantity of heat which can be removed by heat conduction, because of the increase in carbon fiber amount.

The material of filler and the material of resin binder were variously changed to evaluate various properties including heating temperature. Here, the mixing ratio of the soft magnetic powder and the mixing ratio of the filler were fixed at 84.90% and 4.5%, respectively, which are the same as in Example 10, in which the heating temperature was minimum in Table 3.

As the thermally conductive filler, "CF1" alone was used in Example 12, and carbon fibers obtained by mixing "CF1" and "CF2" in a mass ratio of 1:1 were used in Example 13. Injection-molded reactors which were the same as in Example 10 except the thermally conductive filler were produced, and were evaluated for various properties including heating temperature.

Furthermore, materials other than carbon fibers were also investigated as the material of filler. A powder of aluminum nitride was used as a filler in place of the carbon fibers. High-quality bulk materials of aluminum nitride are an electrically insulating, highly thermally conductive material having a thermal conductivity of about 300 (W/m·K), and as fillers thereof for addition to resins, a spherical powder (average particle diameter, 1 μm) of about 180 (W/m·K) is on the market. The electrical resistance thereof is about $10^{18}$ (μΩ·m). This filler is used in Comparative Example 5.

As another material of filler, a powder of boron nitride was used as a filler. High-quality bulk materials of boron nitride are an electrically insulating, highly thermally conductive material having a thermal conductivity of about 390 (W/m·K), and as fillers thereof for addition to resins, a flaky powder (average particle diameter, 10 μm) of about 60 (W/m·K) is on the market. The electrical resistance thereof is about $10^{18}$ (μΩ·m). This filler is used in Comparative Example 6.

In Example 14, an investigation was made on a change of the material of resin binder, specifically, a change from the thermoplastic resin binder to a thermosetting resin binder. Here, use was made of a thermosetting resin binder including: a bisphenol A epoxy resin (Mitsubishi Chemical Corp.; product name, jER828) as a thermosetting-resin main component; an acid anhydride-based curing agent (Mitsubishi Chemical Corp.; product name, jER Cure YH309) as a curing agent; an imidazole-based curing accelerator (Mitsubishi Chemical Corp.; product name, jER Cure EM124) as a curing accelerator; and a fine silica powder (Nippon Aerosil Co., Ltd.; product name, Aerosil; average particle diameter, 1 μm) as a thickener (sedimentation inhibitor). The ratio was (thermosetting-resin main component):(curing agent):(curing accelerator):(sedimentation inhibitor)=(100 parts by mass):(90 parts by mass):(2 parts by mass):(20 parts by mass).

As a thermally conductive filler, "CF2" was used as in Example 10. The soft magnetic powder, the reactor structure, and the coil to be embedded were the same as in Example 10. The reactor was produced not by the injection molding method described above but by potting in the manner described below.

The soft magnetic powder, the thermally conductive filler, and the resin binder are mixed together to prepare a liquid slurry. While keeping the coil in the state of being suspended from above in a potting case, the slurry is injected into the potting case so that the coil is embedded. This potting case which contains the coil and the slurry is held in a heating furnace at 100° C. for 3 hours and then at 150° C. for about 6 hours to cure the slurry. Thereafter, the molded body is taken out of the potting case to obtain a reactor. The sedimentation inhibitor was used for the purpose of preventing the soft magnetic powder from sedimenting during the curing treatment.

In Table 4 are shown the results of evaluation of various properties including heating temperature which were obtained in the case where the material of filler and the material of resin binder were changed as shown above.

TABLE 4

| Results of measurements of various properties | | | | | | |
|---|---|---|---|---|---|---|
| | X | Y | Flowability ($cm^3$/10 min) | Inductance (μH) | Loss (W) | Heating temperature (° C.) |
| | | | Desired value | | | |
| | (% by mass) | (% by mass) | 100 or higher | 300 or higher | 100 or lower | 115 or lower |
| Example 12 | 84.90 | 4.5 | 322 | 310 | 92 | 92 |
| Example 13 | 84.90 | 4.5 | 322 | 310 | 88 | 96 |
| Comparative Example 5 | 84.90 | 4.5 | 200 | 310 | 70 | 123 (unacceptable) |
| Comparative Example 6 | 84.90 | 4.5 | 150 | 310 | 70 | 125 (unacceptable) |
| Example 14 | 84.90 | 4.5 | — | 305 | 82 | 105 |

Example 12 attained a lowest value of heating temperature among the Examples according to the invention. This is due to the effect of the use of carbon fibers "CF1", which had a high thermal conductivity, as the whole of the thermally conductive filler, the mixing ratio of which was 4.5%. The loss thereof has increased as compared with Example 10, but satisfies the desired value.

Example 13 is intermediate in loss and heating temperature characteristics between Example 10 and Example 12. This is due to the effect of the mixing of "CF1" and "CF2" in a ratio of 1:1, and indicates that reactors can be produced with some degree of freedom depending on the loss and heating temperature required.

The aluminum nitride and boron nitride used in Comparative Examples 5 and 6 are both in extensive use as fillers for imparting thermal conductivity to resins. In addition, these materials have higher insulating properties than carbon fibers. These materials were hence expected to bring about a higher effect than carbon fibers. However, the results show that these materials were unable to effectively lower the heating temperature although able to reduce the loss.

These results are presumed to be due to the shapes and properties of the powders. Carbon fibers are fibrous (acicular), whereas the aluminum nitride is spherical and the boron nitride is flaky. The reason for those results is presumed to be that the individual particles were hence in the state of being independently present in the resin binder and were unable to form heat conduction channels (heat conduction paths) for effectively dissipating heat. Furthermore, in the case of carbon fibers, the fibrous particles are separated so as to split along the longitudinal direction during kneading and finely and evenly dispersed in the resin binder and are capable of thus forming a network of heat conduction paths. In contrast, since the aluminum nitrate has high hardness, the particles during kneading cannot be separated and finely dispersed scatteringly. In the case of the boron nitride, the flaky particles partly exfoliate to give thinner flaky pieces, but this filler has poor dispersibility and does not form an effective network of heat conduction paths. The reduced flowability in Comparative Example 6 is thought to be attributable to the poor dispersibility.

Figure 14:
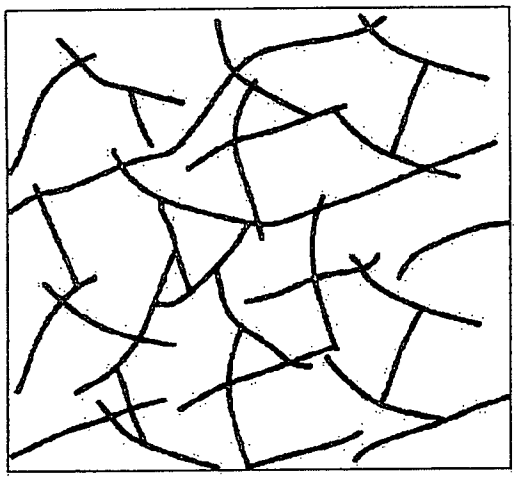
FIG. 14 describes views diagrammatically showing that a thermally conductive fibrous filler is apt to form a heat conduction network.
Figure 14:
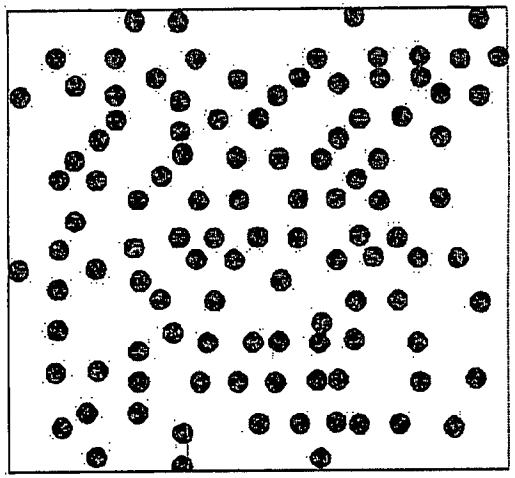

Consequently, fibrous filler may be used suitably as the thermally conductive filler. FIG. 14 diagrammatically shows the suitability.

In the case of a thermally conductive filler which is fibrous, this thermally conductive filler, that is, the fibers, is dispersed in the state of being entangled with one another, thereby effectively constituting a network of heat conduction paths as shown in (A). As a result, this filler exhibits high heat dissipation properties.

Meanwhile, in the case of a thermally conductive filler which is particulate or the like, the particles of the filler are less apt to be entangled with one another as shown in (B). Consequently, even in cases when the addition amount thereof is increased, it is difficult to satisfactorily form a network.

In this respect, it is desirable to use a thermally conductive filler which is fibrous.

It is preferable that the thermally conductive fibrous filler to be used should be one which has an aspect ratio (length/diameter) of 5 or higher, from the standpoint that a network of heat conduction paths can be satisfactorily formed. In this case, the fiber diameter (average fiber diameter) thereof is preferably 10 μm or less, and the fiber length (average fiber length) thereof is preferably 10 μm or more.

Example 14 has smaller values of inductance and loss and a higher heating temperature as compared with Example 10, but all these values satisfy the desired values. The reason for these differences is thought to be that the coefficient of linear thermal expansion and the thermal conductivity have changed due to the changes in production process and in the material of resin binder. It can hence be seen that regardless of whether a thermoplastic resin or a thermosetting resin is used, the heating temperature of the core can be effectively lowered.

Incidentally, in each of the Examples and Comparative Examples shown in Tables 1 to 4, the results of the withstand voltage test and thermal shock test were acceptable.

The proportion X of the soft magnetic powder and the proportion Y of the thermally conductive filler can be determined in the following manner.

Specifically, X and Y can be determined in accordance with JIS K 7250 (2006) "Plastics/Method for Determining Ash Content". Although method A is basically used to make measurements, method B or method C may be used according to need.

However, an operation including the following treatments 1 to 6 is conducted because it is necessary to distinguish the soft magnetic powder, the thermally conductive filler and other ashes, respectively, and to diminish the influence of oxidation.

First, the weight of a test sample is measured before the treatments, and this weight is expressed by W0.

[Treatment 1] This test sample is put in a platinum crucible, heated at 950° C. for about 3 hours in a muffle furnace in a nitrogen atmosphere, returned to room temperature, and then weighed. This weight is expressed by W1.

[Treatment 2] Subsequently, the sample which has undergone treatment 1 is heated in dry air at 750° C. for about 3 hours, returned to room temperature, and then weighed. This weight is expressed by W2.

[Treatment 3] The sample which has undergone treatment 2 is pulverized and sorted with a magnet, and the portion which has adhered to the magnet is weighed. This weight is expressed by W3.

[Treatment 4] The portion which remains unadhered to the magnet is weighed, and this weight is expressed by W4.

[Treatment 5] The sample obtained in treatment 3 is heated in a hydrogen atmosphere at 950° C. for about 3 hours, returned to room temperature, and then weighed. This weight is expressed by W5.

[Treatment 6] The sample obtained in treatment 4 is heated in dry air at 1,000° C. for about 3 hours, returned to room temperature, and then weighed. This weight is expressed by W6.

Treatment 1 is conducted in order to remove any inorganic additives, components formed by hydrolysis and volatile components of any inorganic additives or any organic additives which are contained in the resin binder of the sample.

Treatment 2 is conducted in order to pyrolyzed and remove, in an oxidizing atmosphere, the resin component of the resin binder contained in the sample.

Treatment 3 is conducted in order to recover the soft magnetic powder from the residue resulting from treatment 2.

With respect to treatment 4, since the soft magnetic powder has been removed from the residue, the ashes of the additives contained in the thermally conductive filler and the resin binder remain.

Treatment 5 is conducted in order to reduce the soft magnetic powder which, in the state of having undergone treatment 3, may have an increased weight due to oxidation by treatment 2 and to thereby obtain the weight of the soft magnetic powder more accurately.

In treatment 6, the sample obtained in treatment 4 is heated in an oxidizing atmosphere having a higher temperature to thereby pyrolyze the carbon fibers as a thermally conductive filler, leaving ashes only.

Consequently, X and Y are determined using the following equations.

$$X=W5/W0\times100$$

$$Y=(W4-W6)/W\times100$$

As the test sample for determining the X and Y, either a sample cut out, in an appropriate amount, of any desired portion of the core material of the reactor or a sample taken out, at any timing, from the compound discharged from a kneader can be used. In this case, it is desirable that X and Y should be determined from average values obtained through examination of a plurality of test samples.

Although embodiments and Examples of the invention were described above in detail, these are mere examples. The invention can be configured in variously modified modes so long as the modifications do not depart from the spirit of the invention.

DESCRIPTION OF REFERENCE NUMERALS

10: Coil
15: Reactor
16: Core

The invention claimed is:

1. A reactor comprising:

a core comprising a coil and a molded body, wherein the coil comprises a wound electric wire, wherein the molded body comprises a material for the core containing a soft magnetic powder, a resin binder, and a thermally conductive fibrous filler having a higher thermal conductivity than that of the soft magnetic powder, mixed in a proportion represented by following expression (1), wherein the coil is embedded in an inner portion of the molded body without an interval to configure the reactor, $$X\cdot(\text{soft magnetic powder})+Y\cdot(\text{thermally conductive filler})+(100-X-Y)\cdot(\text{resin binder})\ldots \quad \text{expression (1)}$$

wherein X is 83% to 96% by mass and Y is 0.2% to 6.8% by mass, and wherein the soft magnetic powder comprises Si in a range from 0.2% to 9.0% by mass.

2. An injection-molded reactor comprising the reactor according to claim 1, wherein a thermoplastic resin binder is used as the resin binder, wherein a compound for the core, as the material for the core, obtained by mixing in the proportion represented by the expression (1) is used, and wherein the core is injection-molded by using the compound for the core in a state where the coil is embedded in the inner portion of the molded body without an interval to configure the injection-molded reactor.

3. The injection-molded reactor according to claim 2, wherein the thermally conductive filler comprises carbon fibers.

4. A compound for the core as the material for the core of the injection-molded reactor according to claim 2.

5. A compound for the core as the material for the core of the injection-molded reactor according to claim 3.

6. The reactor according to claim 1, wherein the Si in the soft magnetic powder is in a range from 6.5% to 9.0% by mass.

7. The reactor according to claim 1, wherein the Si in the soft magnetic powder is in a range from 6% to 7% by mass.

8. The reactor according to claim 1, wherein the Si in the soft magnetic powder is in a range from 2% to 3% by mass.

9. The reactor according to claim 1, wherein the soft magnetic powder further comprises at least one of Cr, Mn, and Ni.

10. The reactor according to claim 1, wherein the soft magnetic powder further comprises 5% by mass or less of Cr.

11. The reactor according to claim 10, wherein the soft magnetic powder further comprises Mn and Ni with a total content of 1% by mass.

12. The reactor according to claim 1, wherein the soft magnetic powder further comprises Mn and Ni with a total content of 1% by mass.

13. The reactor according to claim 1, wherein a particle diameter of the soft magnetic powder is in a range of 1 μm to 500 μm.

14. The reactor according to claim 1, wherein a particle diameter of the soft magnetic powder is in a range of 10 μm to 150 μm.

15. The reactor according to claim 1, wherein X is in a range from 91% to 93% by mass.

16. The reactor according to claim 15, wherein Y is in a range from 0.2% to 2.8% by mass.

17. The reactor according to claim 15, wherein Y is in a range from 0.5% to 1.5% by mass.

18. The reactor according to claim 1, wherein X is in a range from 83% to 96% by mass and Y is about 1%.

19. The reactor according to claim 1, wherein the thermally conductive filler comprises carbon fibers.

20. The reactor according to claim 19, wherein Y is about 4.5% by mass.

* * * * *